US006567048B2

(12) United States Patent
McKinzie, III et al.

(10) Patent No.: US 6,567,048 B2
(45) Date of Patent: May 20, 2003

(54) REDUCED WEIGHT ARTIFICIAL DIELECTRIC ANTENNAS AND METHOD FOR PROVIDING THE SAME

(75) Inventors: William E. McKinzie, III, Fulton, MD (US); Greg Mendolia, Ellicott City, MD (US)

(73) Assignee: e-Tenna Corporation, Del Mar, CA (US)

( * ) Notice: Subject to any disclaimer, the term of this patent is extended or adjusted under 35 U.S.C. 154(b) by 0 days.

(21) Appl. No.: 09/917,291

(22) Filed: Jul. 26, 2001

(65) Prior Publication Data

US 2003/0020655 A1 Jan. 30, 2003

(51) Int. Cl.[7] ..... H01Q 1/36

(52) U.S. Cl. ..... 343/700 MS; 343/767; 343/756; 343/909

(58) Field of Search ..... 343/700 MS, 767, 343/770, 756, 909, 895; 333/134, 202, 204

(56) References Cited

U.S. PATENT DOCUMENTS 5,473,334 A * 12/1995 Yee et al. ..... 343/756
5,712,605 A 1/1998 Flory et al. ..... 333/219.1
5,870,057 A * 2/1999 Evans et al. ..... 343/700 MS
5,926,136 A * 7/1999 Ohtsuka et al. ..... 343/700 MS
6,075,485 A 6/2000 Lilly et al. ..... 343/700 MS
6,121,931 A * 9/2000 Levi ..... 343/700 MS
6,147,572 A * 11/2000 Kaminski et al. ..... 333/134
6,208,316 B1 * 3/2001 Cahill ..... 333/134
6,218,978 B1 * 4/2001 Simpkin et al. ..... 342/5
6,219,002 B1 4/2001 Lim ..... 343/769

* cited by examiner

*Primary Examiner*—Tan Ho
(74) *Attorney, Agent, or Firm*—Pillsbury Winthrop LLP

(57) ABSTRACT

An artificial anisotropic dielectric material can be used as a microstrip patch antenna substrate. The artificial dielectric can be easily designed for the purpose of weight reduction. Preferably, the artificial dielectric is comprised of a periodic stack of low and high permittivity layers. The layers can be oriented vertically below the patch to support electric fields consistent with desired resonant modes. Substrates may be engineered for both linearly and circularly polarized patch antennas. Antenna weight can be reduced to ⅙th up to 1/30th of the original weight using different types of high permittivity layers. This concept has numerous applications in electrically small and lightweight antenna elements such as PIFA antennas. In accordance with one aspect of the invention, the artificial dielectric is comprised of an interlocking structure of low and high permittivity layers for ease of assembly and for overall stability. In accordance with another aspects the high permittivity layers can be comprised of FSS cards, and can include metallized tabs for further simplification of assembly.

49 Claims, 24 Drawing Sheets

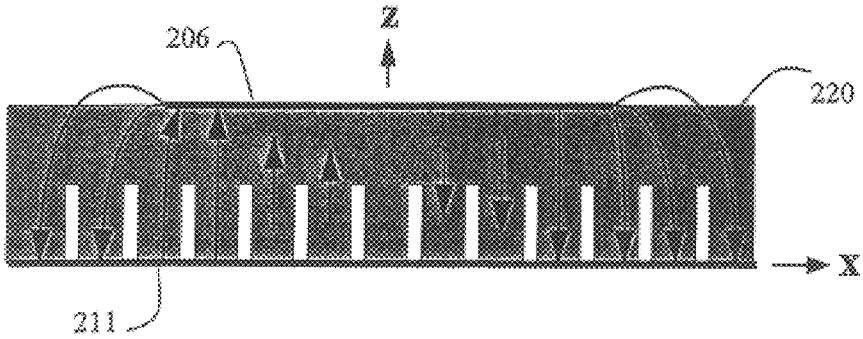
FIG. 17E1
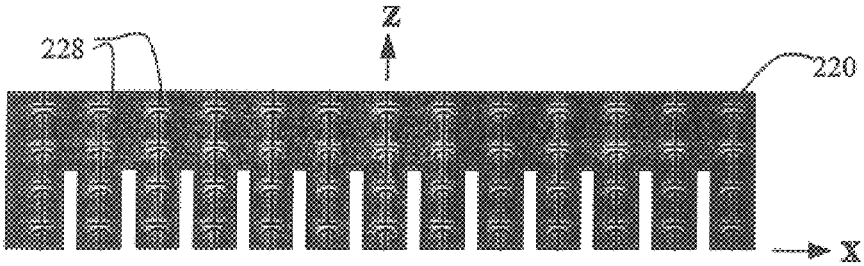
FIG. 17E2
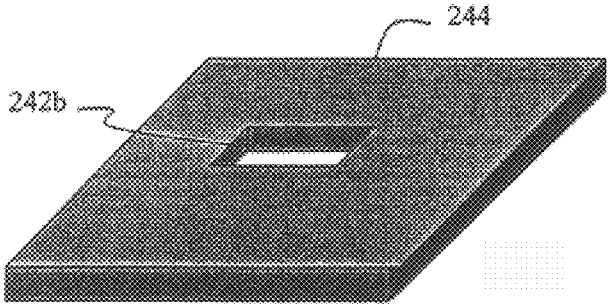
FIG. 17F
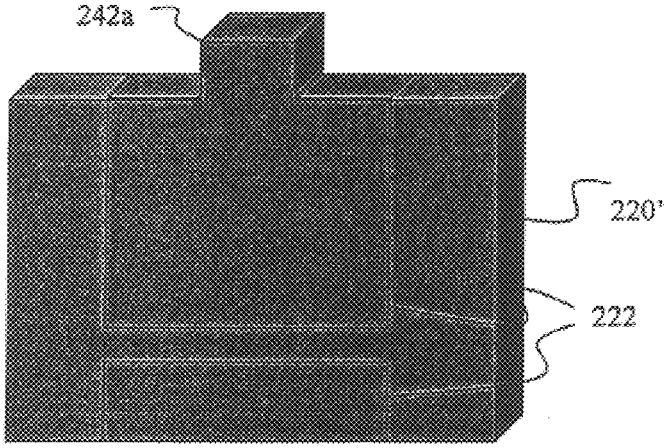

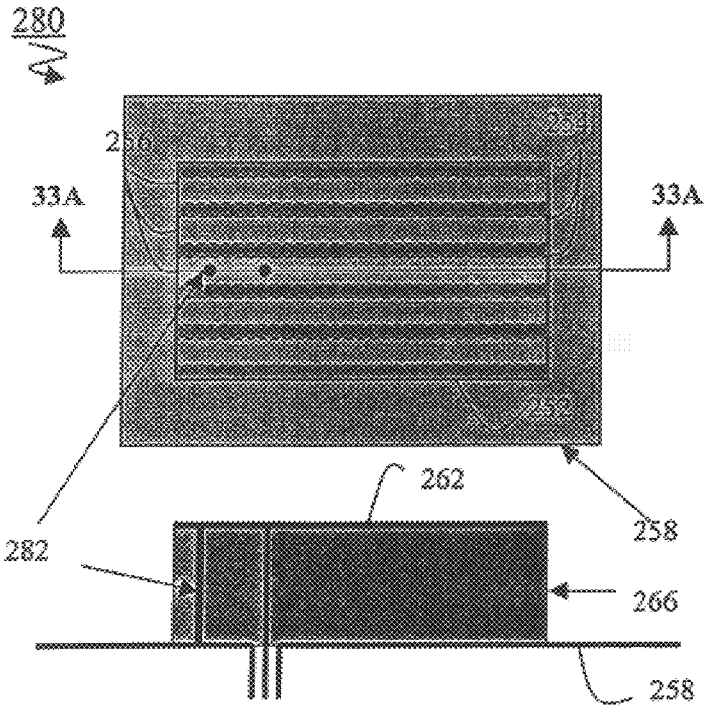
FIG. 33
FIG. 33A
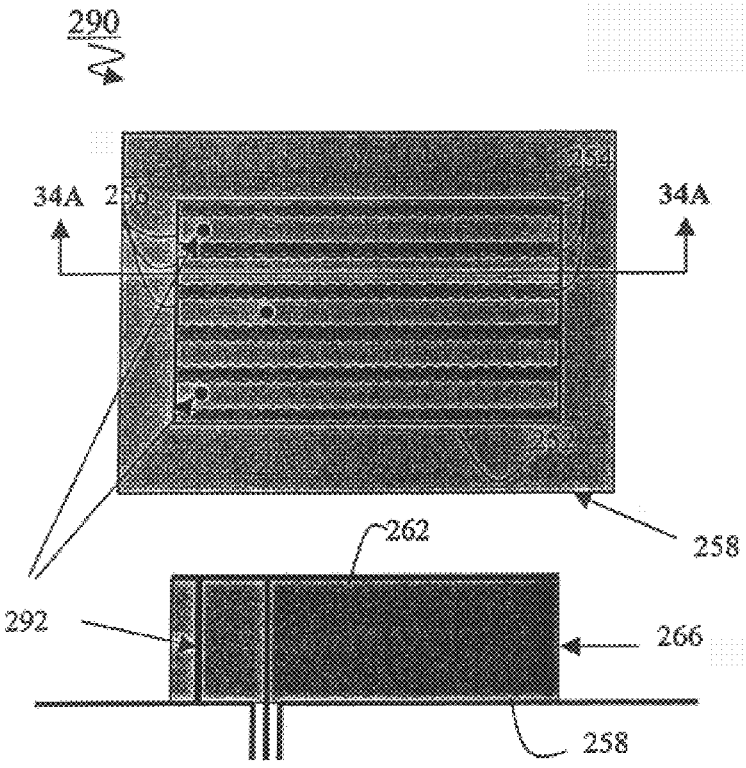
FIG. 34
FIG. 34A

REDUCED WEIGHT ARTIFICIAL DIELECTRIC ANTENNAS AND METHOD FOR PROVIDING THE SAME

BACKGROUND OF THE INVENTION

1. Field of the Invention

The present invention relates to antennas and dielectric substrate materials therefor, and in particular, to various antenna applications such as microstrip antennas.

2. Description of the Related Art

A top view of a conventional probe-fed microstrip patch antenna 10 is illustrated in FIG. 1. A cross-sectional view of antenna 10 taken along line 2—2 in FIG. 1 is illustrated in FIG. 2. As shown, antenna 10 consists of a radiating element being a rectangular conductive patch 12 printed on the upper surface of a dielectric substrate 14 having uniform height H and having a relative permittivity tensor $\in$. The lower surface 16 of the substrate is also metalized, and a coaxial connector 18 attaches the shielded outer conductor of coaxial cable 24 thereto. The center conductor 20 of coaxial cable 24 serves as a feed probe and protrudes up through the substrate so as to electrically connect to the patch 12 at feed 22.

Dielectric substrate 14 of conventional microstrip patch antenna 10 is an homogeneous substrate. Typically, the dielectric materials forming substrate 14 are isotropic, where there exists no preferred dielectric polarization direction (i.e. $\in_x=\in_y=\in_z$). In some cases though, the homogeneous substrate is an anisotropic dielectric with a uniaxial relative permittivity tensor given by $$\varepsilon = \begin{pmatrix} \varepsilon_x & 0 & 0 \\ 0 & \varepsilon_y & 0 \\ 0 & 0 & \varepsilon_z \end{pmatrix} \tag{1}$$

Where $\in_x=\in_y\neq\in_z$ and the z axis (the uniaxial axis, i.e. the axis of anisotropy) is normal to the plane of the patch. As dielectric materials, many woven materials such as fiberglass exhibit such uniaxial behavior as a result of their manufacturing techniques. However, this type of anisotropy is usually slight. Since the material's uniaxial axis (z axis) is normal to the patch surface, the anisotropy is tolerated but not desired as it complicates the antenna, design process without yielding any corresponding benefit.

Another consideration in the selection of dielectric materials is weight. For example, the weight of a microstrip patch antenna operating at low frequencies (below 1 GHz) can be excessive due to the large physical dimensions of the, substrate and/or the high specific gravity of the material comprising the substrate. For mobile applications involving autos, aircraft, and spacecraft, antenna weight can be a serious engineering constraint, even for higher frequency antennas.

The length L of a patch antenna printed on a low permittivity substrate (foam, for example has a relative permittivity $\in_r$ of about 1.1) is approximately $\lambda/2$, where $\lambda$ is the free space wavelength. For a given resonant frequency, the patch dimensions may be reduced by the approximate scale factor of 1/sqrt($\in_r$) by using a higher permittivity substrate, where $\in_r$ is the relative permittivity of the isotropic substrate. At low frequencies, reducing the size of the patch antenna by appropriate selection of higher permittivity substrates is even more desired because $\lambda$ becomes large. For example, $\lambda$=1 meter at 300 MHz. However, even though such high permittivity substrates can reduce the patch dimensions, the overall weight of the antenna can be increased. This is because high permittivity, high quality substrate materials such as RT/duroid (a trademark of Rogers Corp. of Rogers, Conn.), for example, have a specific gravity of from 2.1 to 2.9 grams/cm$^3$. Microwave quality ceramic materials can be even heavier with a typical specific gravity of from 3.2 to 4 grams/cm$^3$.

One solution is to make the substrates thinner (i.e., making the height H smaller) to reduce their overall volume and, hence, their weight. This can be done while maintaining the antenna's resonant frequency. However, the 2:1 VSWR bandwidth (and the 1 or 3 dB gain bandwidth) will decrease almost linearly in proportion to the height reduction of the substrate. Microstrip antennas are inherently narrow band even without reducing this height. For example, an element such as that shown in FIG. 1 with a 10% substrate height to patch length ratio (i.e., H/L=0.10) has a 2:1 VSWR bandwidth of only 1.8% ($\in_r$=6) to 3.5% ($\in_r$=1). So this approach to weight reduction can only be used for very narrow bandwidth applications, and is unsuitable for broadband applications.

Schuss (U.S. Pat. No. 5,325,103) proposed the use of a high dielectric syntactic foam as a lightweight substrate material under a patch antenna. He does not specify the value or range of permittivities used. However, experience has shown that such high permittivity foam materials usually have high loss tangents, and high loss tangents are responsible for significant gain degradation in electrically small elements. In contrast, low loss tangent dielectrics (tan $\delta$<0.002) are required to build a patch antenna with high radiation efficiency in excess of 90%, especially if the antenna is electrically small (patch length L<$\lambda$/4).

What is needed in the art, therefore, is a new technique to achieve a significant weight reduction in dielectric substrate materials suitable for various antenna applications without compromising the bandwidth or radiation efficiency characteristics of such antennas. There is a further need for a substrate material having such advantages that can be fabricated simply.

SUMMARY OF THE INVENTION

The present invention is directed to dielectric materials, and particularly to an artificial anisotropic dielectric material that can be used as a microstrip patch antenna substrate. The artificial dielectric can be easily designed for the purpose of weight reduction. Preferably, the artificial dielectric is comprised of a periodic stack of low and high permittivity layers. The layers can be oriented vertically below the patch to support electric fields consistent with desired resonant modes. Substrates may be engineered for both linearly and circularly polarized patch antennas. Antenna weight can be reduced to ⅙th up to 1/30th of the original weight using different types of high permittivity layers. This concept has numerous applications in electrically small and lightweight antenna elements such as PIFA antennas. In accordance with one aspect of the invention, the artificial dielectric is comprised of an interlocking structure of low and high permittivity layers for ease of assembly and for overall stability. In accordance with another aspect, the high permittivity layers can be comprised of FSS cards, and can include metallized tabs for further simplification of assembly.

BRIEF DESCRIPTION OF THE DRAWINGS

These and other objects and advantages of the present invention will become apparent to those skilled in the art after considering the following detailed specification, together with the accompanying drawings wherein:

FIG. 17A-1 illustrates high permittivity slabs with notches that permit interlocking;

FIGS. 17A-2 and 17A-2' illustrate a dual polarized microstrip antenna employing an interlocking artificial dielectric substrate with slabs that are skewed so as to form non-right angle dihedral angles between them;

FIGS. 17A-3 and 17A-3' illustrate a dual polarized microstrip antenna employing an interlocking artificial dielectric substrate with slabs that are radially disposed in relation to each other;

FIGS. 17A-4 and 17A-4' illustrated a dual polarized microstrip antenna employing an interlocking artificial dielectric substrate with slabs that have non-uniform spacing among them;

FIG. 17E1 illustrates the paths of electric flux in an FSS card such as that illustrated in FIGS. 17C and 17D;

FIG. 17E2 illustrates an electric circuit representation of an FSS card such as that illustrated in FIGS. 17C and 17D;

FIG. 17F illustrates a partial view of an FSS card having a tab that facilitates assembly in accordance with an aspect of the invention;

FIG. 33 is a top view illustrating a PIFA containing an anisotropic artificial dielectric substrate in accordance with an alternative embodiment of the present invention;

FIG. 33A is a cross-sectional view of the PIFA of FIG. 33 taken along lines 33A—33A;

FIG. 34 is a top view illustrating a PIFA containing an anisotropic artificial dielectric substrate in accordance with yet an alternative embodiment of the present invention, and FIG. 34A is a cross-section view of the PIFA of FIG. 34 taken along lines 34A—34A.

DETAILED DESCRIPTION OF THE PREFERRED EMBODIMENTS

Figure 3:
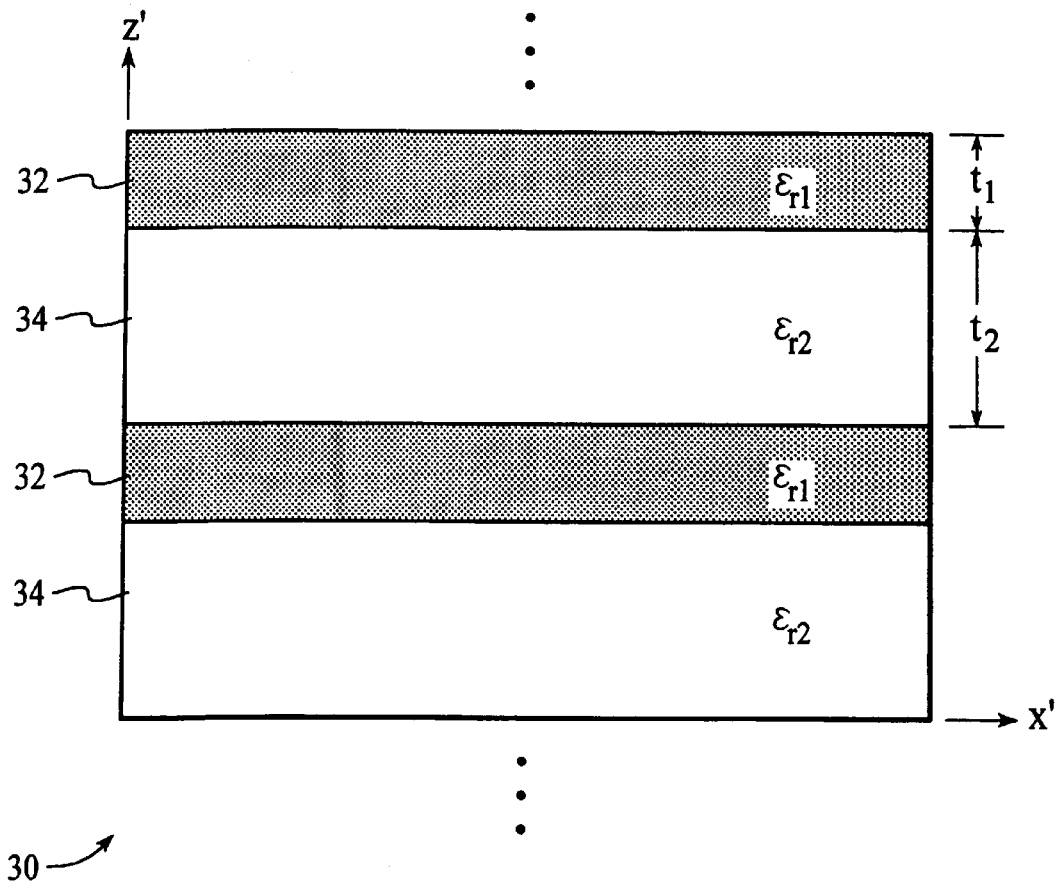
FIG. 3 illustrates a layered artificial dielectric material constructed in accordance with the principles of the present invention.

An artificial dielectric structure 30 according to the present invention is shown in FIG. 3. It comprises a periodic structure or stack of alternating layers of high and low permittivity isotropic dielectric materials 32 and 34, having respective relative permittivities of $\in_{r1}$ and $\in_{r2}$. As shown in the drawing, layers 32 and 34 have respective thicknesses of $t_1$ and $t_2$, and the direction normal to the surface of the layers is parallel with the z axis. The number of alternating layers 32 and 34 used in the stack depends on their respective thicknesses and the overall size of the structure desired.

Although the individual layers 32 and 34 are preferably isotropic with relative permittivities of $\in_{r1}$ and $\in_{r2}$ respectively, as constructed together in the periodic structure of FIG. 3, the composite structure 30 is an anisotropic dielectric. Its permittivity tensor is given by equation (2), where the z' axis is normal to the stack surface (i.e., parallel to the direction in which the layers are stacked) as shown in FIG. 3. The principal axes of the artificial dielectric are denoted with primed coordinates x', y' and z'.

$$\varepsilon = \begin{pmatrix} \varepsilon_{x'} & 0 & 0 \\ 0 & \varepsilon_{y'} & 0 \\ 0 & 0 & \varepsilon_{z'} \end{pmatrix} \tag{2}$$

Diagonal elements are approximated at low frequencies by $$\epsilon_{x'} = \epsilon_{y'} = \frac{\epsilon_{r1}t_1 + \epsilon_{r2}t_2}{t_1 + t_2} = \frac{\epsilon_{r1} + \epsilon_{r2}(t_2/t_1)}{1 + (t_2/t_1)}, \tag{3}$$

$$\epsilon_{2'} = \frac{(t_1 + t_2)}{(t_1/\epsilon_{r1}) + (t_2/\epsilon_{r2})}, \tag{4}$$

and $$\omega_{x'} = \omega_{y'} > \omega_{z'} \tag{5}$$

Figure 4:
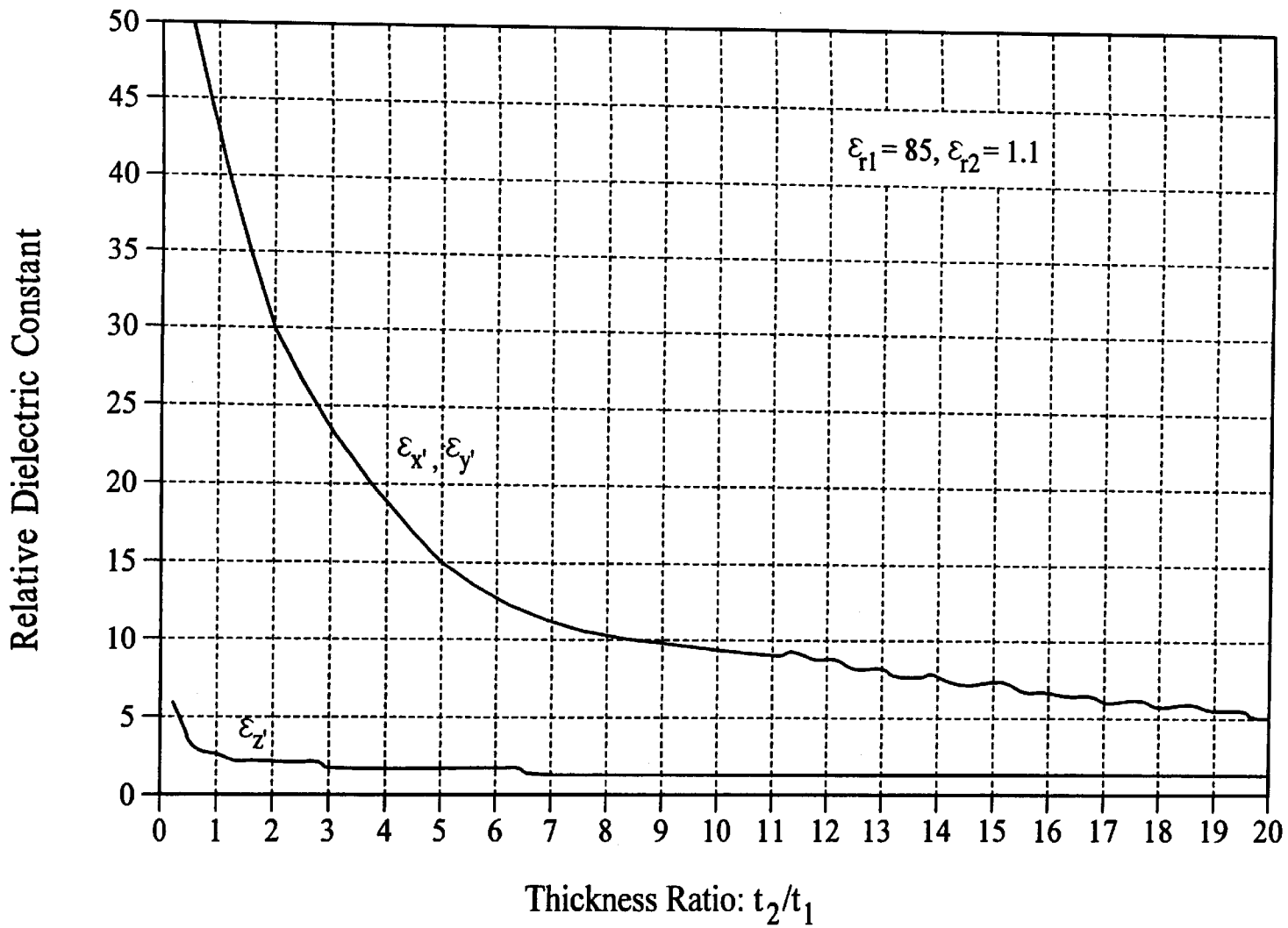
FIG. 4 is a graph illustrating the permittivities achieved vs. thicknesses of layers in one example of an artificial dielectric material such as that illustrated in FIG. 3.

Low frequencies are those frequencies f ($\omega = 2\pi f$) for which the electrical thickness $\beta_n t_n << 1$, where $\beta_n = \omega \times \mathrm{sqrt}(\mu_0 \in_0 \in_{rn})$ for n=1,2. According to an aspect of the invention, the physical, thickness $t_n$ of each layer is thus an engineering parameter which may be varied subject to the condition that $t_n << 1/\beta_n$. One of the merits of the structure of FIG. 3 is that tensor permittivities $\in_{x'}$ and $\in_{y'}$ can be engineered to be any value between $\in_{r1}$ and $\in_{r2}$ by appropriate selection of the respective thicknesses for given respective permittivities of layers 32 and 34. FIG. 4 is a graph showing an example of the invention where relative permittivity values of 45 down to 5 are obtained for thickness ratios ($t_2/t_1$) of from 1 to 20.

It should be noted that $\in_{x'}$ and $\in_{y'}$ are not necessarily equal. They can, in fact, be designed to be unequal while still yielding an anisotropic artificial dielectric structure. Generally, however, in the specific applications that will be described in more detail herein, both $\in_x$ and $\in_y$ will be greater than $\in_z$ by factors of from 5 to 10.

The weight of the resulting structure 30 can be easily designed as well. Particularly, if the specific gravity of layers 32 and 34 are denoted as $sg_1$ and $sg_2$ respectively, then the effective specific gravity of the composite dielectric, $sg_{eff}$, (assuming all other dimensions of layers 32 and 34 are the same) is $$sg_{eff} = \frac{sg_1 t_1 + sg_2 t_2}{t_1 + t_2} \tag{5}$$

Accordingly, a significant weight savings can be achieved by selecting a thin high permittivity dielectric material for layer 32 and a much thicker but very low weight dielectric material such as foam for layer 34.

As an example, consider that an homogeneous microwave quality ceramic substrate (for example, alumina, $\in_r \approx 10$) typically has a specific gravity of about 3.2 grams/cm$^3$. To replace it with an artificial dielectric material of similar permittivity according to the present invention, layer 32 can be chosen to be a higher permittivity ceramic with $\in_{r1} \approx 85$ and $sg_1 \approx 3.2$ grams/cm$^3$, and layer 34 a foam spacer such as Rohacell foam ($\in_{r2} \approx 1.1$ and $sg_2 \approx 0.1$). As shown in the chart in FIG. 4, this yields an effective pernmittivity $\in_{x'}$ and $\in_{y'}$ of about 10 for a thickness ratio of $t_2/t_1 = 8.4$. Meanwhile for this same thickness ratio, the effective specific gravity $sg_{eff}$ from equation (5) is only 0.43. Accordingly, a substrate comprised of an artificial dielectric structure according to the invention and having the same overall dimensions will weigh only about 14% as much as the homogenous substrate.

Even greater weight savings can be achieved when the high permittivity dielectric material layer 32 is itself an artificial dielectric material, such as a frequency selective surface (FSS). Such materials have traditionally been used to filter plane waves in applications such as antenna radomes or dichroic (dual-band) reflector antennas. However, in this new application, a capacitive FSS is used as a subsystem component in the design of a larger artificial dielectric material: i.e., the periodic structure 30. For example, a 0.020" thick FSS can be designed to represent an equivalent capacitance of up to $\in_r = 800$, while exhibiting a specific gravity of only about ~2.5 grams/cm$^3$, further improving the results obtained in the above example.

Figure 5:
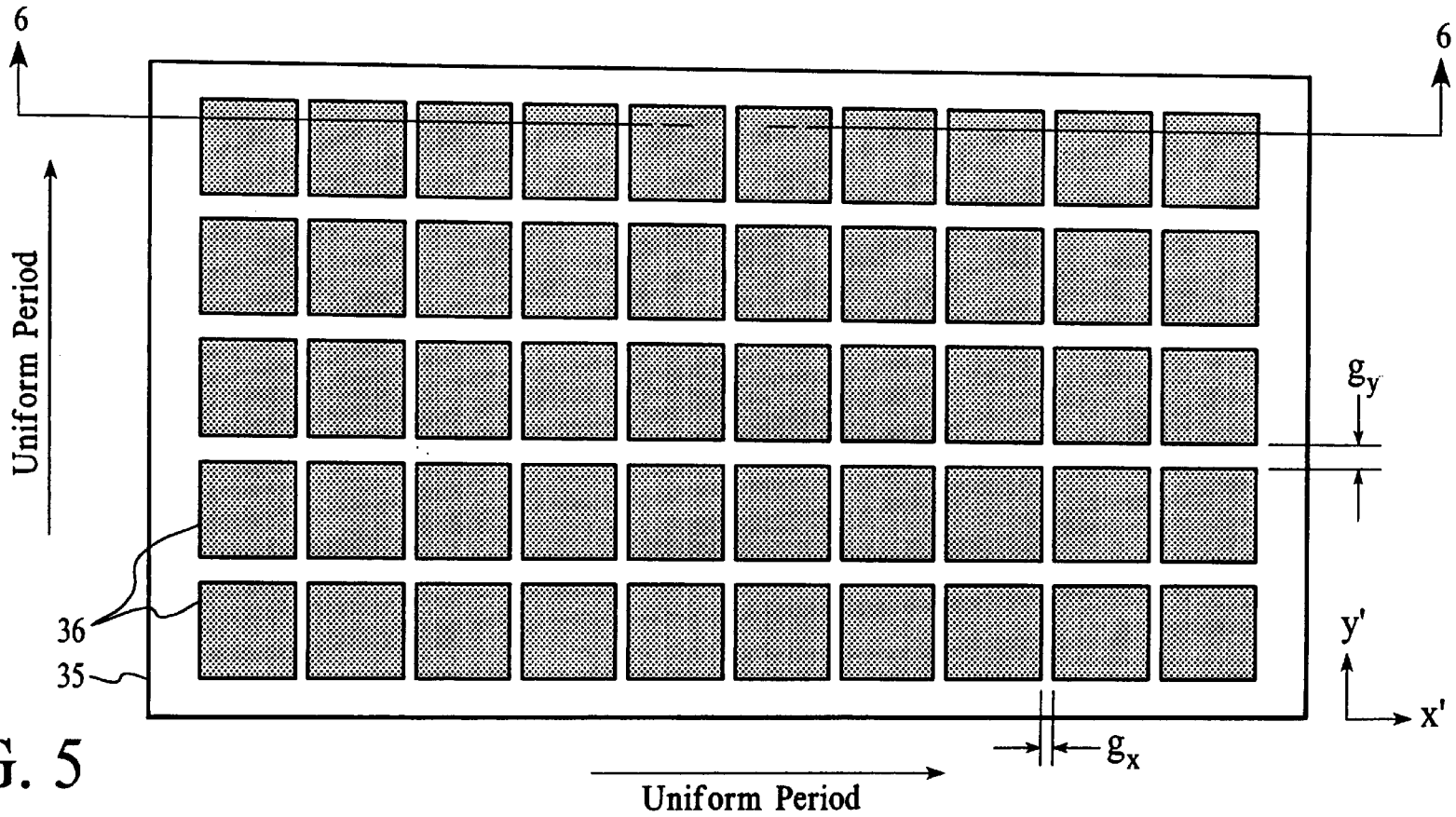
FIG. 5 is a top view of one example of a frequency selective surface for use in a layered artificial dielectric material in accordance with the principles of the invention.
Figure 6:
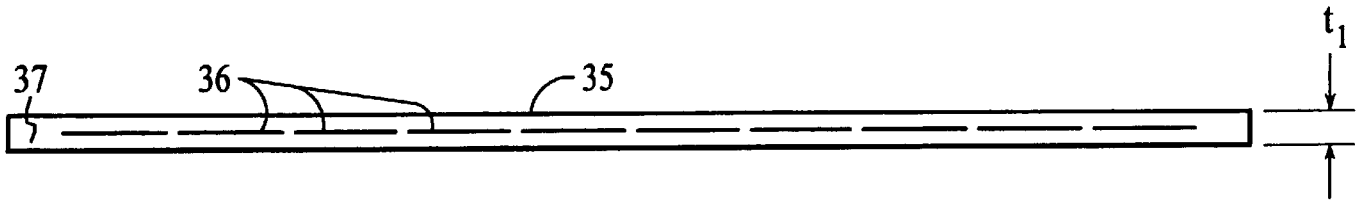
FIG. 6 is a side view of the FSS in FIG. 5 taken along sectional line 6—6.

As shown in FIGS. 5 and 6, a frequency selective surface (FSS) 35 for possible use as a high permittivity dielectric material 32 in structure 30 is an electrically thin layer of engineered material (typically planar in shape) which is typically comprised of periodic metallic patches or traces 36 laminated within a dielectric material 37 for environmental protection.

The electromagnetic interaction of an FSS with plane waves may be understood using circuit analog models in which lumped circuit elements are placed in series or parallel arrangements on an infinite transmission line which models the plane wave propagation. FSS structures are said to be capacitive when their circuit analog is a single shunt capacitance. This shunt capacitance, C (or equivalent sheet capacitance), is measured in unit's of Farads per square, area. Equivalently, the reactance presented by the capacitive FSS can be expressed in units of ohmns per square area. This shunt capacitance is a valid model at low frequencies where $(\beta_1 t_1) << 1$, and $t_1$ is the FSS thickness. As a shunt capacitance, electromagnetic energy is stored by the electric fields between metal patches. Physical implementations of capacitive FSS structures usually contain periodic lattices of isolated metallic "islands" such as traces 36 upon which bound charges become separated with the application of an applied or incident electric field (an incident plane wave). The periods of this lattice are much less than a free space wavelength at frequencies where the capacitive model is valid. The equivalent relative dielectric constant of a capacitive FSS is given as $\in_r = C/(\in_0 t_1)$ where $\in_0$ is the permittivity of free space. FSS structures can be made with $\in_r$ values extending up to several hundred.

An important point to note is that $\in_r$ may be made polarization sensitive by design. That is, in practical terms, the lattice spacing or island shape, or both, may be different for the x' and y' directions where these axes are the principal axes of the lattice. This yields equivalent sheet capacitance values which are polarization dependent. Thus $\in_{rx}$ for x' polarized applied electric fields may be different from $\in_{ry}$ for y' polarized E fields which is the case for an anisotropic FSS.

FIG. 5 is a top view of an anisotropic FSS 35 comprised of square metal patches 36 where each patch is identical in size, and buried inside a dielectriclayer 37 (such as FR-4). FIG. 6 is a cross-sectional side view of FIG. 5 taken along sectional line 6—6 of FIG. 5. As shown, the gaps between patches 36 are denoted as $g_x$ in the x' direction and $g_y$ in the y' direction. If these variables are different dimensions, as shown in this figure, then the equivalent capacitance provided by the FSS is different for electric fields polarized in the x' and y' directions Since $g_x$ is smaller than $g_y$, the equivalent sheet capacitance for x'-polarized E fields will be larger than for y'-polarized E fields. For a given value of incident E field, more energy will be stored for the x' polarized waves than for the y' polarized waves. This leads to $\in_{rx}>\in_{ry}$ in the FSS, and $\in_{x'}>\in_{y'}$ in the equivalent bulk permittivity for a layered substrate when it is included in a non-homogeneous stacked dielectric substrate according to the invention such as substrate 30 (assuming that the second layer is isotropic, such as foam).

It should be apparent that there are FSS design parameters, other than the gap width, which may yield unequal $\in_{rx}$ and $\in_{ry}$. For instance, the patches may be rectangular in shape.

Figure 7:
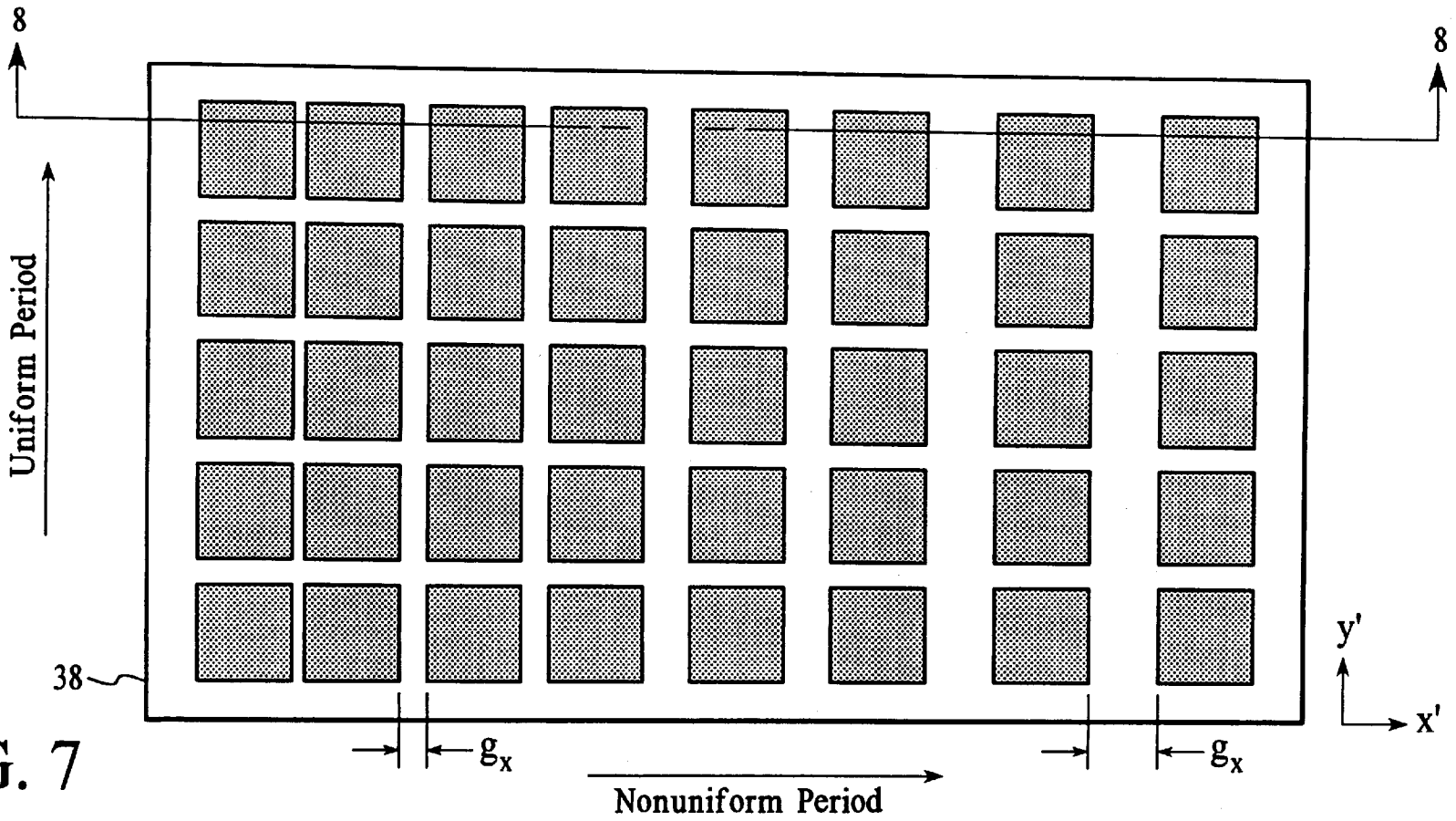
FIG. 7 is a top view of another example of a frequency selective surface for use in a layered artificial dielectric material in accordance with the principles of the invention.
Figure 8:
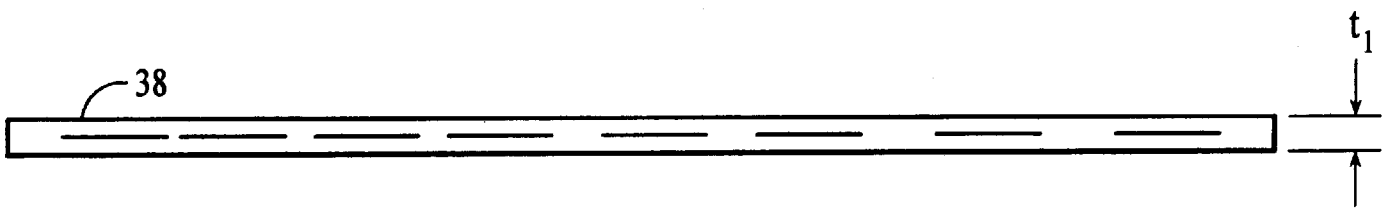
FIG. 8 is a side view of the FSS in FIG. 7 taken along sectional line 8—8.

FIGS. 7 and 8 illustrate variations on this theme where the equivalent sheet capacitance is intended to be relatively constant or uniform with position for y'-polarized E fields, but is engineered to vary with position in the x' direction since the gap size $g_x$ varies with position in the x' direction. So not only are $\in_{rx}$ and $\in_{ry}$ unequal, but the degree of inequality is a function of position within the FSS 38. This difference in tensor permittivity could be gently graded or modified in discrete steps. In the extreme case, both $\in_{rx}$ and $\in_{ry}$ could be made to vary with position on the FSS. Furthermore, the lattice principal axes don't have to be orthogonal, they could be skewed at an arbitrary angle other than 90°. It should be apparent that there are almost countless variations.

The FSS designs shown above are not meant to be limiting. Rather, it should be apparent that many different FSS designs can yield a broad range of equivalent sheet capacitances with equal or unequal polarization. For further information regarding such materials, see generally T. K. Wu, "Frequency Selective Surface and Grid Array" (1995); C. K. Lee and R. J. Langley, "Design of a Single Layer Frequency Selective Surface," Int. J. Electronics, Vol. 63, pp. 291–296, March 1987.

An artificial dielectric structure 30 such as that illustrated in FIG. 3 can be fabricated in several different ways. For example, the foam spacer layers 34 can be sprayed with an aerosol adhesive such as Repositionable 75 Spray Adhesive made by 3M, and the ceramic or FSS layers 32 bonded thereto. When the desired number of layers are stacked together, force can be applied via a simple press or jig to compress the stack of layers. In another example, the high permittivity layers 32 are suspended in a fixture with the correct separation and orientation. Next, a foam such as a syntactic foam is injected between the layers to fill the voids. When the foam cures, thereby forming the low permittivity layers 34, a rigid block of artificial dielectric material is produced. As a further example, the artificial dielectric material is built entirely from printed FSS sheets that are soldered together like a card cage. The top, bottom, and sides of the structure are comprised of printed circuit cards that have periodic arrays of plated-through slots to accept and locate the tabs on the FSS sheets serving as high permittivity layers 32. Air gaps or spaces between the FSS sheets create the low permittivity layers 34. A standard soldering process such as wave soldering or vapor-phase reflow could be used for cost-effective assembly. Further, if the bottom and side cards are metalized over their full surface, they could also serve as an antenna cavity.

It should be noted that the artificial dielectric structure illustrated in FIG. 3 is vastly different from conventional artificial dielectric materials, which typically have metallic islands or inclusions suspended in a lightweight dielectric binder. Descriptions of materials having inclusions of spheres, ellipsoids, strips, conductive fibers, and other shapes have been published. See, for example L. Lewin, "The Electrical Constants of Spherical Conducting Particles in a Dielectric," Jour. IEEE (London), Vol. 94, Part III, pp. 65–68, January 1947; R. W. Corkum, "Isotropic Artificial Dielectrics," Proc. IRE, Vol. 40, pp. 574–587, May 1952; M. M. Z. Kharadly et al., "The Properties of Artificial Dielectrics Comprising Arrays of Conducting Elements," Proc. IEE (London), Vol. 100, Part III, pp. 199–212, July 1953; S. B. Cohn, "Artificial Dielectrics for Microwaves," in Modern Advances in Microwave Techniques, Polytech Inst. Brooklyn Symposium Proc., Vol. 4, pp. 465–480, November 1954; R. E. Collin, "Artificial Dielectrics," in Field Theory of Guided Waves, Ch. 12, pp. 509–551 (1960); Leonard S. Taylor, "Dielectric Properties of Mixtures," IEEE Transactions on Antennas and Propagation, Vol. AP-13, No. 6, pp. 943–947, November 1965.

It should be further noted that although the structure in FIG. 3 is akin to structures in optics known as multilayer films or 1D Bragg gratings (i.e., Bragg stacks), there are many important differences. Such Bragg structures are used in optical mirrors and filters, wherein at optical frequencies the typical electrical thickness of each layer is at least 0.5 radian, and the typical physical thickness of each layer is 100 to 1000 micrometers (0.004 to 0.040 in.). Moreover, in such applications, wave propagation is in the z' direction of FIG. 3, normal to the layer surface.

In contrast, the artificial dielectric structure of the present invention is proposed for applications with much lower frequencies, typically less than 1 GHz. Furthermore, although the individual dielectric layers are physically much thicker (0.040 in.$<t_1,t_2<$0.5 in.), the operating frequencies are so much lower that each layer is electrically very thin (0.04 to 0.08 radians near 300 MHz, i.e., $\beta_n t_n << 1$). Also, in further contrast to optical applications, in antenna applications that will be described inshiore detail below, the wave propagation direction for standing waves under the patch is parallel to the layered surface, not perpendicular (i.e., in the x' or y' directions of FIG. 3).

Figure 9:
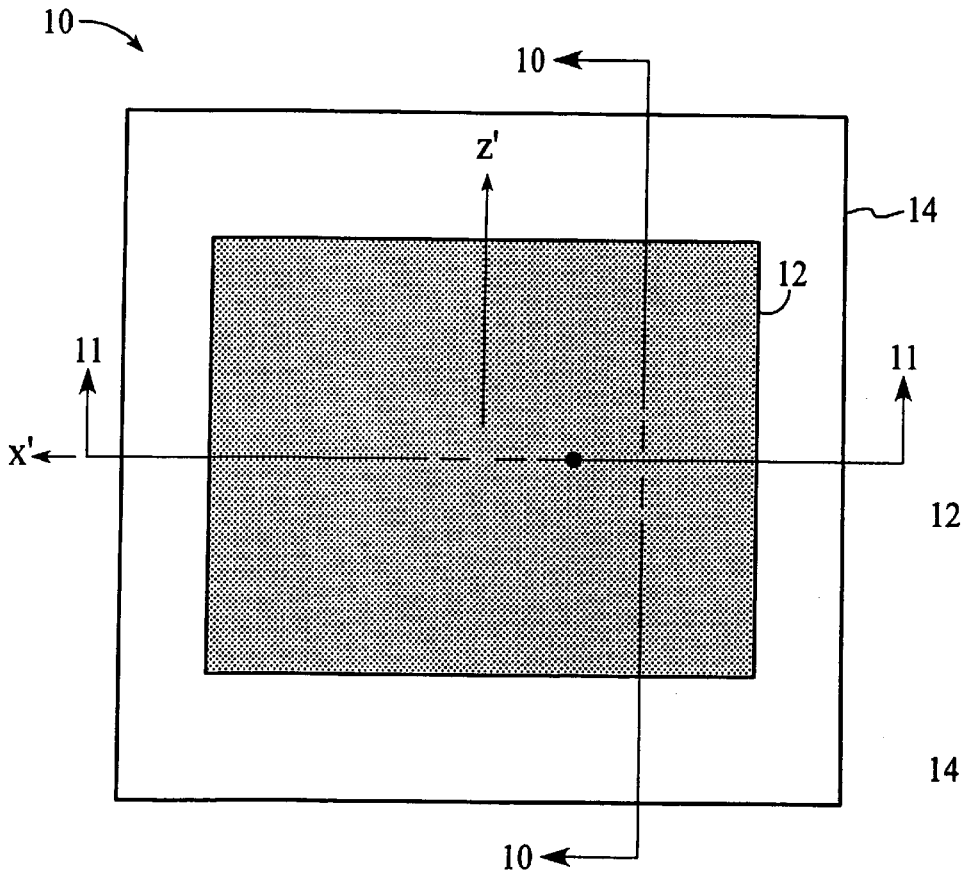
FIG. 9 (PRIOR ART)
FIG. 9 is a top view of a conventional linearly-polarized patch antenna.
Figure 10:
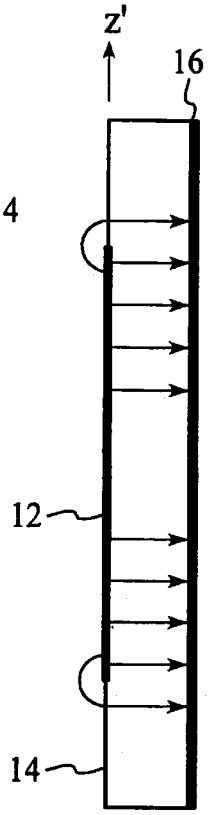
FIG. 10 (PRIOR ART)
FIGS. 10 and 11 are side views illustrating the dominant mode electric field lines in the antenna illustrated in FIG. 9 taken along sectional lines 10—10 and 11—11, respectively.
Figure 11:
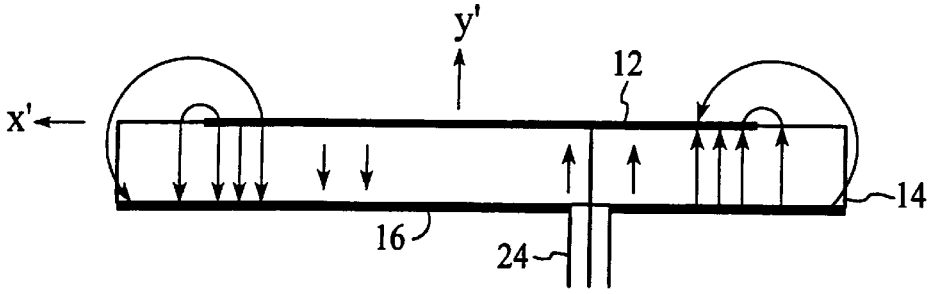
FIG. 11 (PRIOR ART)

To illustrate the application of the artificial dielectric structure of the present invention to substrates of patch antennas, first consider the conventional linearly-polarized patch antenna 10 illustrated in FIG. 9. FIGS. 10 and 11 are cross-sectional side views of antenna 10 taken along sectional lines 10—10 and 11—11, respectively. As shown, antenna 10 includes a radiating element being a microstrip patch 12, homogeneous substrate 14, and metalized ground plane 16. FIGS. 10 and 11 illustrate the dominant mode (lowest resonant frequency) electric field lines of patch antenna 10. As illustrated in FIG. 11, patch 12 is resonant in the x' direction with a half sinusoidal variation of vertical electric field (standing wave) under the patch. Surface electric current on the patch is predominantly x'-directed. Note that the electric field lines in substrate 14 are primarily y'-directed (vertical, i.e. perpendicular to the surface of the patch) except at the left and right edges of the patch where a significant x'-directed component is observed due to the fringing fields. The patch is said to radiate from the left and right side edges.

Figure 12:
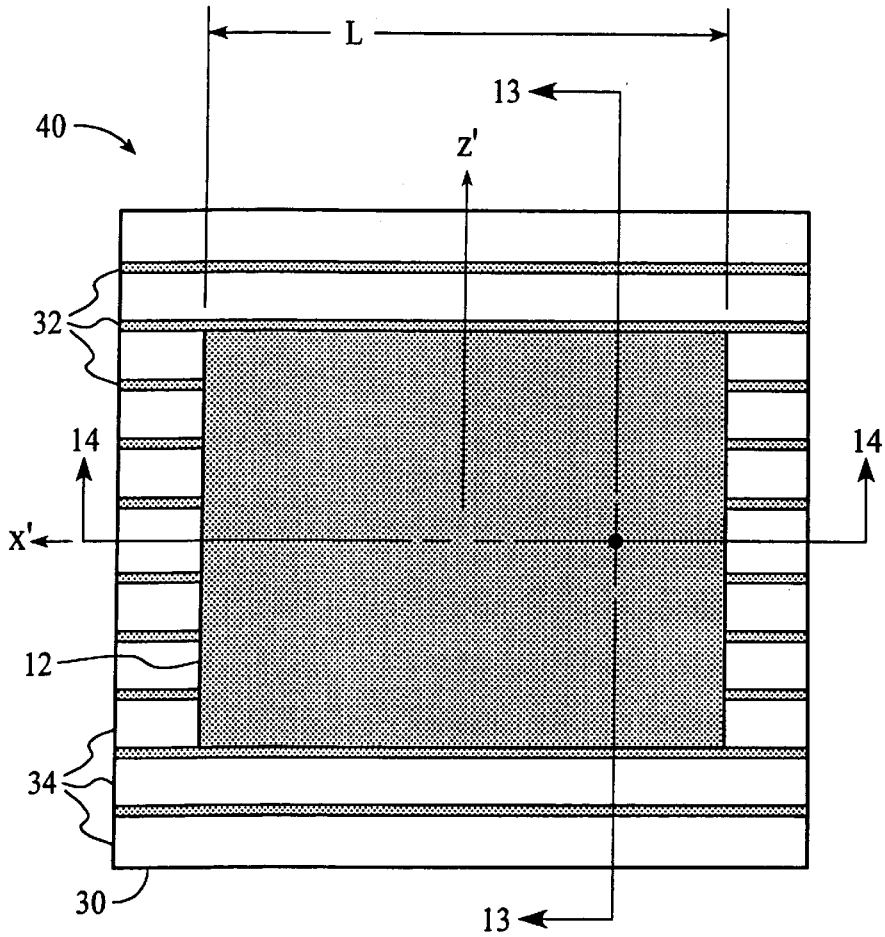
FIG. 12 is a top view of a linearly-polarized patch antenna having an artificial dielectric substrate according to the present invention.
Figure 13:
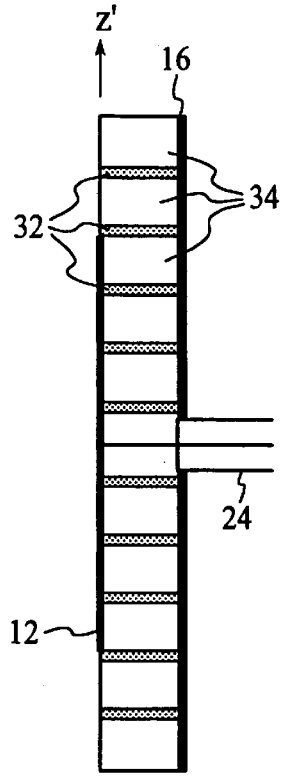
FIGS. 13 and 14 are side views of the antenna illustrated in FIG. 12 taken along sectional lines 13—13 and 14—14 respectively.
Figure 14:
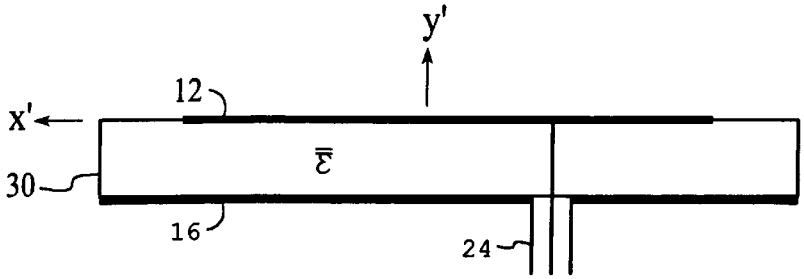

FIGS. 12 through 14 illustrate a linearly-polarized patch antenna 40 according to the invention. FIG. 12 is a top view, and FIGS. 13 and 14 are cross-sectional views taken along lines 13—13 and 14—14, respectively. As shown, antenna 40 is similar in construction to the conventional patch antenna 10 shown in FIGS. 9 through 11 except that the substrate is comprised of artificial dielectric material 30, having alternating layers 32 and 34 of high and low permittivity dielectric materials, respectively. The high permittivity dielectric layer 32 can be, for example, a ceramic material such as PD-85 made by Pacific Ceramics of Sunnyvale, Calif., or it can be, for example, an artificial dielectric material such as a frequency selective surface. The low permittivity dielectric layer 34 can be, for example, a Rohacell foam spacer. A highly conductive surface such as copper tape (not shown) preferably covers the bottom of substrate 30. For cavity-backed patch antennas, this conductive tape will extend up the sides of the substrate.

One way to achieve the same resonant frequency in patch antenna 40, having an artificial dielectric material substrate in accordance with the invention, as in patch antenna 10 with a homogeneous substrate, is to design the artificial dielectric substrate to exhibit the same relative permittivity in the x' and y' directions. Thus, the same amount of electric energy is stored under and around the patch in both cases (i.e., in both artificial dielectric and homogenous dielectric substrates). Accordingly, FIGS. 12 through 14 illustrate the proper orientation of a lightweight artificial dielectric substrate for this case of linear polarization. Note that the uniaxial axis, that is, the axis of anisotropy (where $\in_{x'}=\in_{y'}\neq\in_{z'}$, for example) is perpendicular to the surfaces of the high dielectric layers (the z' axis in FIGS. 12 and 13, i.e. the direction in which the layers are stacked), and is parallel to the surface of the microstrip patch 12.

In accordance with the invention, by orienting direction of stacking the periodic layers which comprise the artificial dielectric substrate as shown in FIGS. 12 through 14, the same high permittivity in the x' and y' directions is achieved such as what would be available if one used an homogeneous substrate. This allows the dominant mode electric fields of the patch antenna (see FIGS. 10 and 11) to be supported since $E_{x'}$ and $E_{y'}$ components dominate the $E_{z'}$ field component. A relatively low dielectric constant in the z' direction ($\in_{rz'}<=\frac{1}{5}\in_{rx'}$, $\frac{1}{5}\in_{ry'}$) for the artificial dielectric substrate will not impact the electric energy stored under the patch, nor the patch resonant frequency, since the modal field of interest has no significant z' directed electric field component. This finesses the problem of maintaining the same amount of stored electric energy ($dW=\frac{1}{2}\in_r\in_0|E|^2$—as found in the homogenous substrate case) by maintaining a high permittivity only in the directions required by the E-field of the dominant patch mode.

It should be noted here that for a more complex antenna, such as a log-periodic slot array, an anisotropic permittivity tensor in which $\in_{x'}\neq\in_{y'}$ may be desired. In other words, the two directions that are not perpendicular to the surfaces of the stacked layers (i.e.the z' direction) may be designed to have dissimilar relative dielectric constants. This concept may be more easily implemented when printed FSS sheets are used as the high permittivity layers.

Antenna 40 can be, for example, a low weight UHF (240–320 MHz) patch antenna. For purposes of comparison, a conventional patch antenna for this application would include, for example, a homogeneous ceramic slab (8"×8"×1.6") of material PD-13 from Pacific Ceramics of Sunnyvale, Calif. where $\in_r=13$ and the specific gravity is 3.45 grams/cm$^3$. The weight of the homogeneous substrate having the required dimensions would thus be about 12.75 lbs.

In the lightweight substrate design of the present invention, layer 32 of artificial dielectric substrate 30 can be, for example, a 0.045" thick ceramic material, such as PD-85 from Pacific Ceramics of Sunnyvale, Calif. This material has a relative permittivity of $\in_{r1}=85$, a specific gravity of $sg_1=3.82$ grams/cm$^3$, and a loss tangent of less than 0.0015. To achieve an effective relative permittivity of $\in_{x'}=\in_{y'}=13$, from equation (2), layer 34 can be, for example, 0.250" thick Rohacell foam spacers. The Rohacell foam has properties of $\in_{r2}\approx1.1$ and $sg_2\approx0.1$ grams/cm$^3$. Substrate 30 having these design parameters weighs approximately 2 lbs., 2 oz., which is an 83% weight reduction from the conventional homogeneous substrate.

For fixed-frequency UHF applications as described above, patch 12 of FIG. 12 can be a six inch square patch printed on a 8"×8"×0.060" thick Rogers R04003 printed circuit board (not shown). The circuit board is mounted face down so that patch 12 touches the ceramic slabs of the artificial dielectric substrate 30. The fixed frequency patch antenna 40 built according to these specifications resonates near 274 MHz with a clean single mode resonance. Radiation efficiency, as measured with a Wheeler Cap, is 82.2% (−0.853 dB). Swept gain at boresight, and E-plane and H-plane gain patterns, also compare very similarly to the same patch with a homogeneous substrate. However, as shown above, the fixed frequency patch antenna of the present invention having artificial dielectric substrate 30 weigh about 83% less than the patch antenna having a conventional homogeneous substrate.

The fixed-frequency antenna can be converted into a tunable aperture by replacing the printed superstrate that contains simple micro strip patch 12 with a tunable patch antenna (TPA) superstrate such as that described in U.S. Pat. No. 5,777,581. In addition to corner bolts and a center post (not shown), nylon bolts are preferably used to secure the superstrateat intermediate locations. A tunable patch antenna having an artificial dielectric substrate 30 according to the invention demonstrates tuning states whose frequencies cover 269 to 336 MHz. The radiation efficiency exceeds −2 dB at all states with a bias level of ~43 mA/diode.

In another antenna 40 having a lightweight artificial dielectric substrate design according to the present invention, layer 32 of substrate 30 can be, for example, a 0.020" thick FSS (such as part no. CD-800 of Atlantic Aerospace Electronics Corp., Greenbelt, Md. for example) designed to represent an equivalent capacitance of at least 300 for the x' and y' directions of FIG. 3. This FSS is made from one 0.020" thick layer of FR4 fiberglass whose specific gravity is approximately 2.5 grams/cm$^3$. To achieve an effective relative permittivity of $\in_{x'}=\in_{y'}=13\in_0$, layer 34 can be, for example, a 0.0500" thick Rohacell foam of the same type used in the example above. Substrate 30 having these design parameters weighs approximately 6.5 oz., which represents a 97% weight reduction from the conventional homogeneous substrate for this antenna application.

An antenna 40 having a tunable patch antenna (TPA) superstrate as described in U.S. Pat. No. 5,777,581 and having a substrate 30 comprised of the FSS described above tunes from 281.75 to 324.5 MHz, with acceptable return loss and radiation efficiency performance. Such an antenna weighs only 2 lb., 10 oz., including an aluminum housing and all the electronic switches (not shown).

Figure 16:
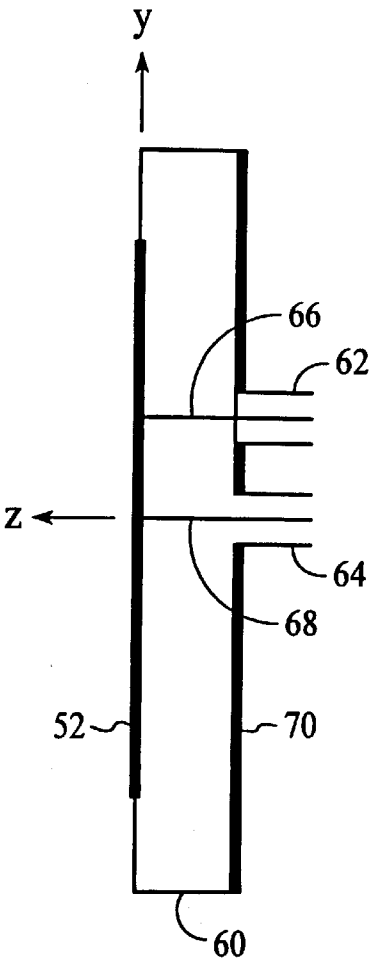
FIG. 16 is a side view of the antenna illustrated in a FIG. 15 taken along sectional line 16—16.
Figure 15:
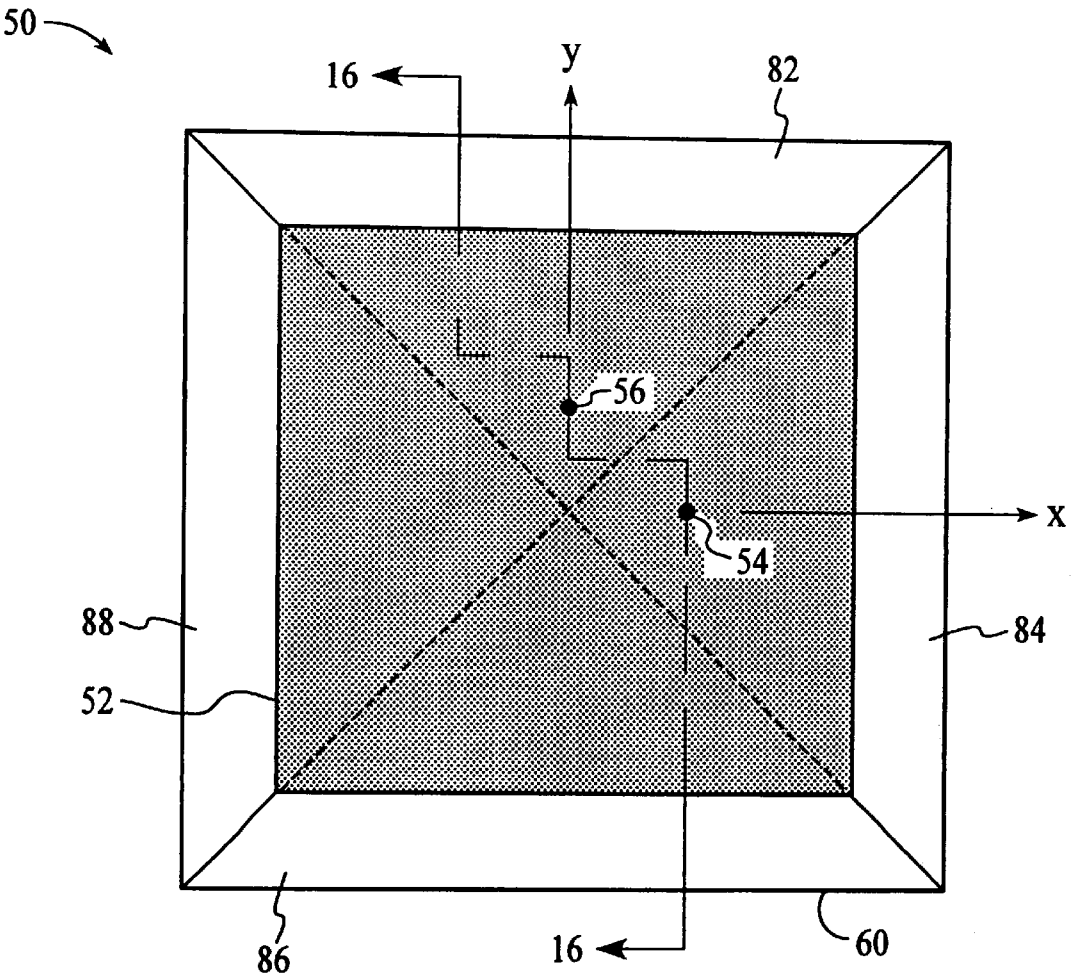
FIG. 15 is a top view of a dual linearly-polarized or circularly-polarized patch antenna having an artificial dielectric substrate according to the present invention.

The use of the periodic artificial dielectric substrate of the present invention can be applied to dual linearly-polarized (or circularly-polarized) patch antennas in addition to linearly-polarized antennas. FIG. 15 shows a dual linearly polarized patch antenna 50 in accordance with the principles of the invention. FIG. 16 is a side view of antenna 50 taken along sectional line 16—16 in FIG. 15. As shown, antenna 50 has a square patch 52, substrate 60, metalized ground plane 70, and two feeds 54 and 56 positioned on the global x and y axes, respectively, and located an equal distance from the patch center. Coaxial cables 62 and 64 have central conductors 66 and 68 (feed probes) that respectively electrically connect to feeds 54 and 56 so as to couple RF energy to the patch. As shown, substrate 60 has four triangularly-shaped regions 82, 84, 86, and 88 that will be described in more detail below.

In antenna 50, the x and y axis feed 54 and 56 couple to independent modes whose dominant patch surface currents are x- and y-directed, respectively. For this square patch, the two modes are degenerate since they have the same resonant frequency. In this case all four sides of the patch radiate. Both vertical and radial electric field components are present all along the patch perimeter. As can be seen, feeds 54 and 56 are positioned on portions of the patch that are respectively disposed over adjacent regions 82 and 84 of substrate 60.

Figure 17:
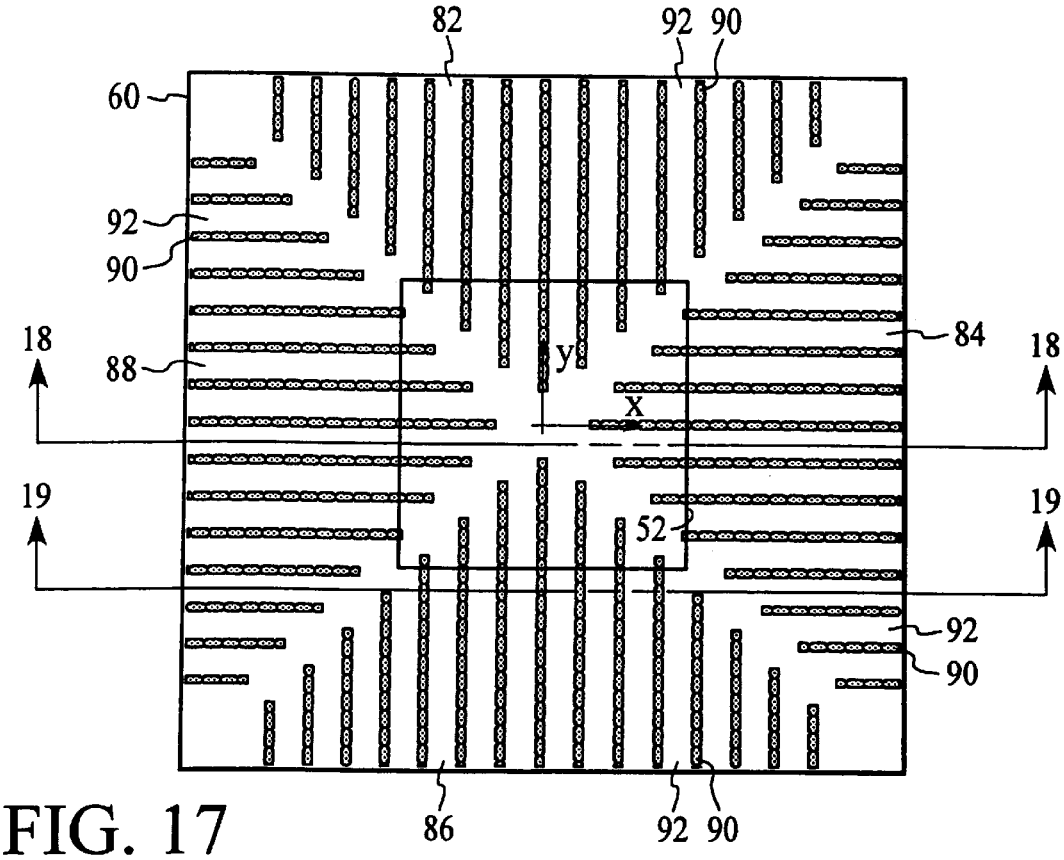
FIG. 17 is a top view illustrating an artificial dielectric substrate that can be used in an antenna such as that illustrated in FIG. 15.
Figure 18:
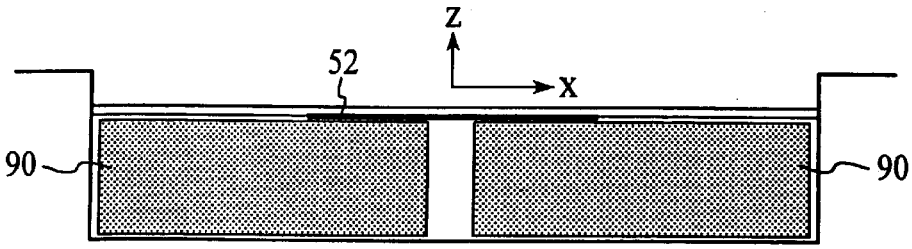
FIGS. 18 and 19 are side views of the artificial dielectric substrate illustrated in FIG. 17 taken along sectional lines 18—18 and 19—19, respectively.
Figure 19:
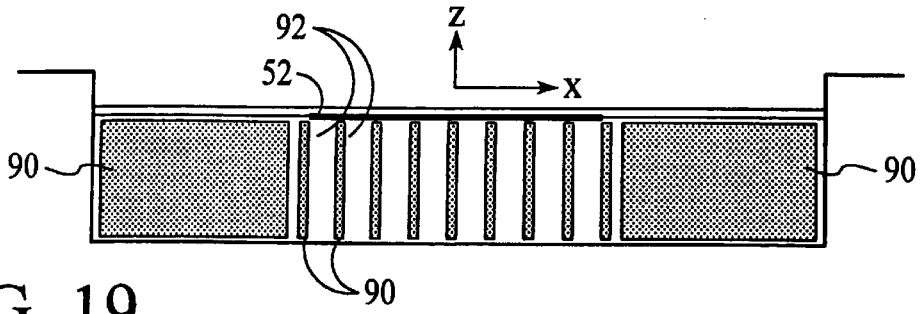

An artificial dielectric substrate 60 that supports dual linear resonant modes is illustrated in FIG. 17. FIGS. 18 and 19 are cross-sectional views of substrate 60 taken along sectional lines 18—18 and 19—19 in FIG. 17, respectively. As can be seen, substrate 60 is composed of four triangular regions 82, 84, 86, and 88. Each region is a separate artificial dielectric structure, having alternating layers of high and low permittivity materials 90 and 92, respectively. The local crystal axes (principal axes) in each artificial dielectric region are $x_n$, $y_n$, and $z_n$ (n=1',2',3',4', where unit vectors $x_n$, $y_n$, and $z_n$ do not necessarily point in the same direction as the global coordinate system (x, y, z)). The uniaxial axis for each region (the local $z_n$ axis, assuming $\in_{x'}=\in_{y'}\neq\in_{z'}$, for example) is parallel to the surface of patch 52 and perpendicular to the surfaces of the layers 90 and 92 within each region, such that it is rotated by 90 degrees in the horizontal plane with respect to the uniaxial axis in each adjacent region (see also FIG. 20). This arrangement permits the fringe electric fields at each edge of the patch to be parallel to the stacked layers (the local $x_n$-$y_n$ planes). As can be further seen, patch 52 and substrate 60 are arranged so that patch 52 overlaps substantially equal portions of regions 82, 84, 86 and 88. The artificial substrate is thus a discrete body of revolution about the global z axis of FIGS. 17–19 which has 4-fold symmetry.

Figure 17A:
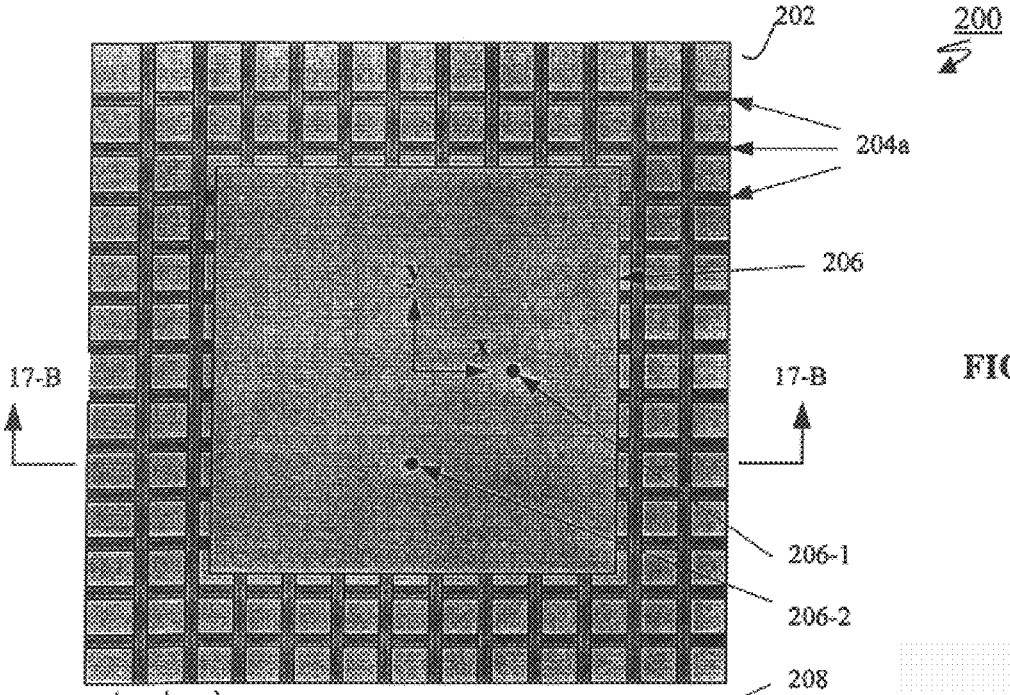
FIGS. 17A and 17B illustrate a dual polarized microstrip antenna employing an interlocking artificial dielectric substrate.
Figure 17B:
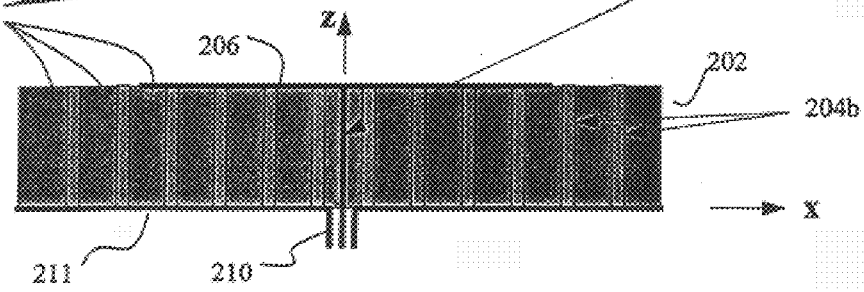
Figures 1, 17A:
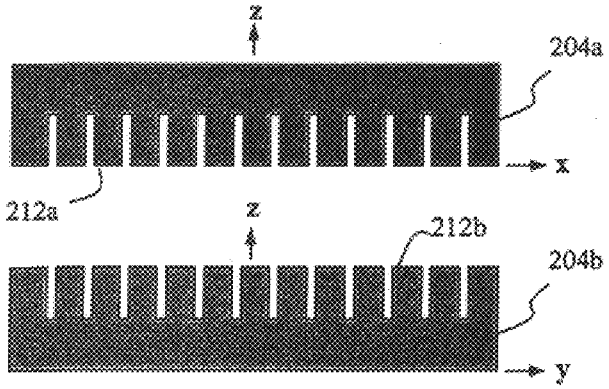
Figures 2, 17A:
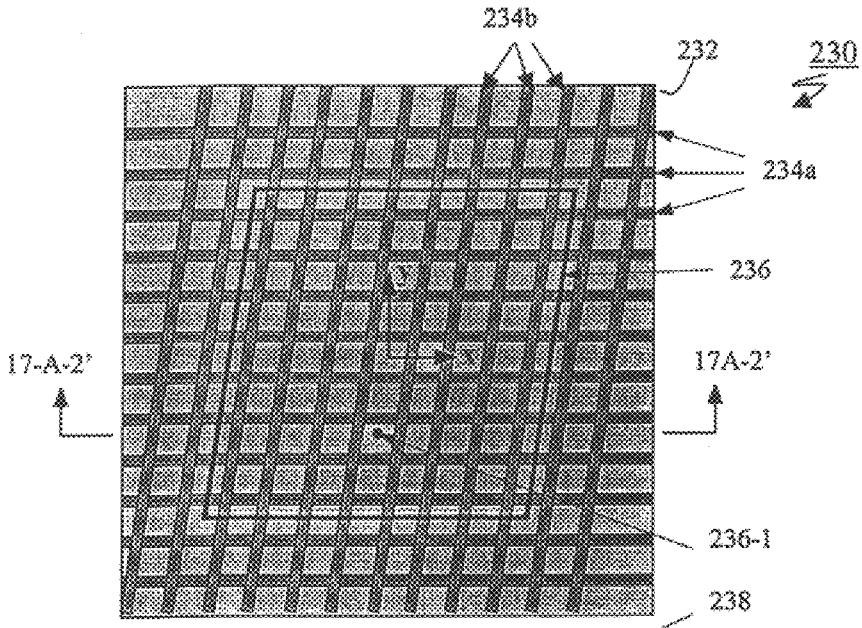
Figures 2, 17A:
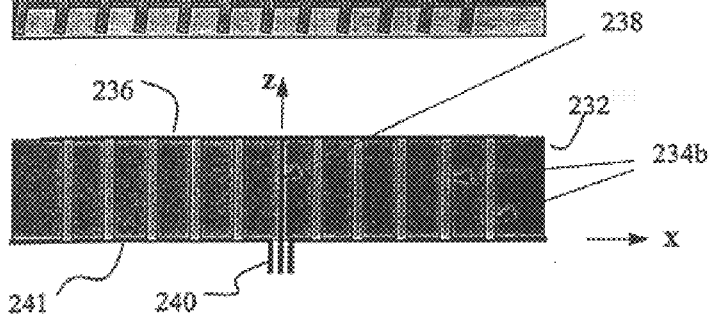
Figures 3, 17A:
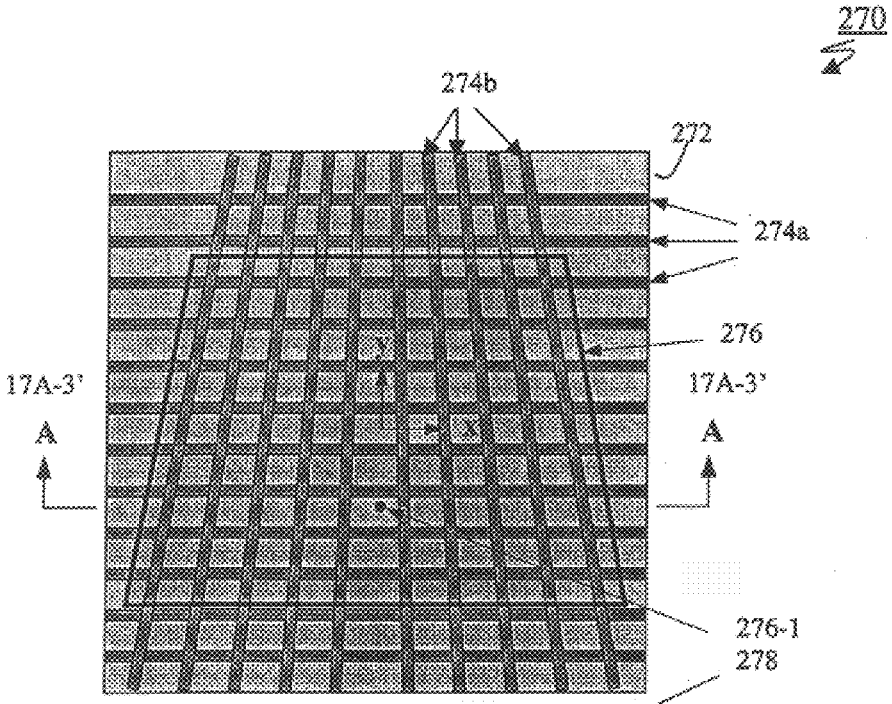
Figures 3, 17A:
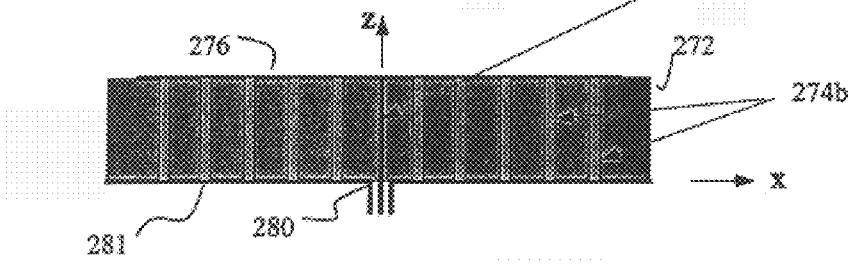
Figures 4, 17A:
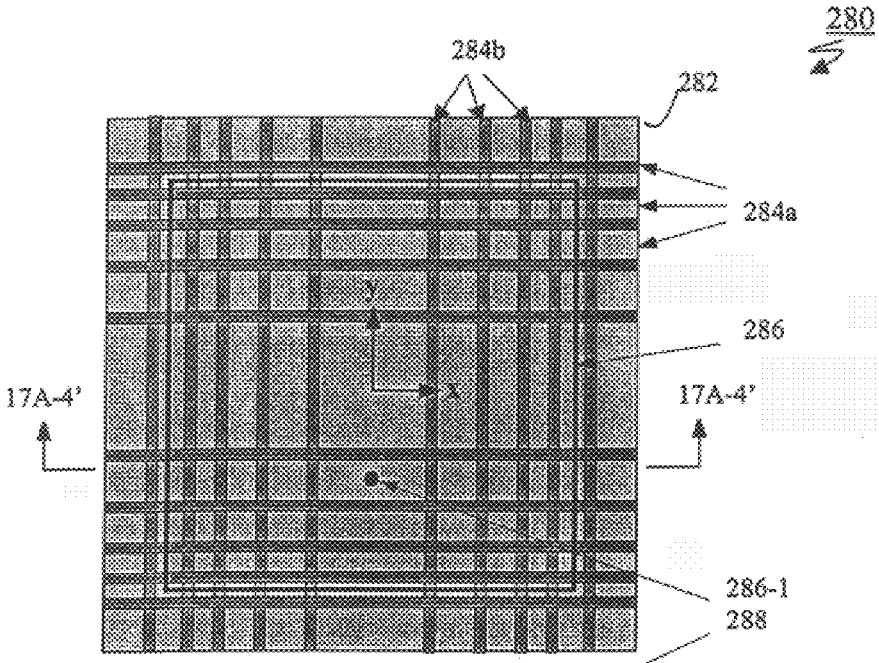
Figures 4, 17A:
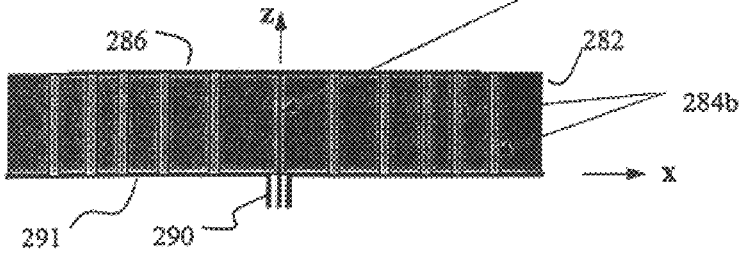

FIG. 17A, and FIG. 17B, which is a cross-sectional view taken along sectional line 17B—17B, illustrate an alternative dual polarized substrate for a microstrip antenna employing an artificial dielectric substrate 202 in accordance with an aspect of the invention. In particular, substrate 202 comprises interlocking high permittivity slabs 204 that are disposed between microstrip patch 206 and ground plane 211. In this example, a set of high permittivity slabs 204*a* are arranged and spaced apart from each other parallel to the x-z plane, and a set of high permittivity slabs 204*b* are arranged and spaced apart from each other parallel to the y-z plane.

Figure 1:
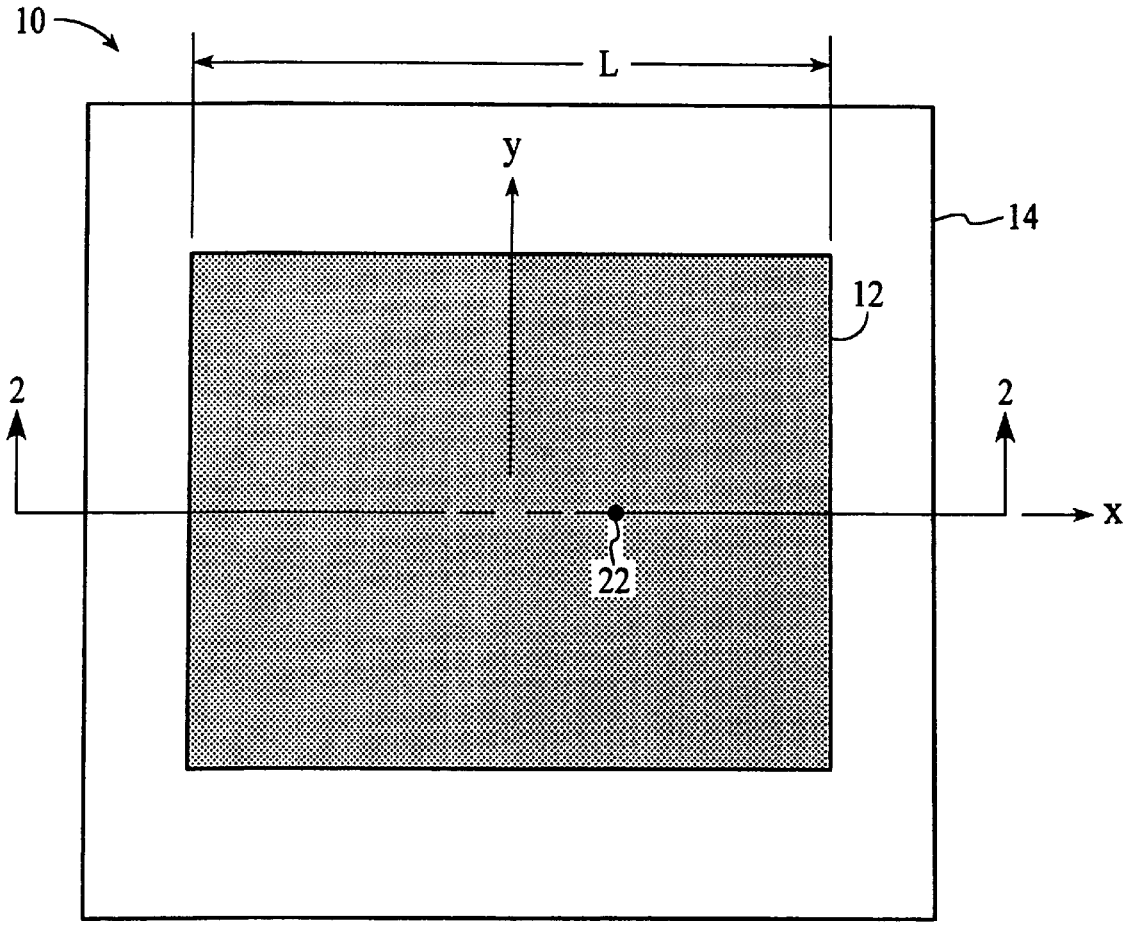
FIG. 1 (PRIOR ART)
FIG. 1 is a top view of a conventional microstrip patch antenna.
Figure 2:
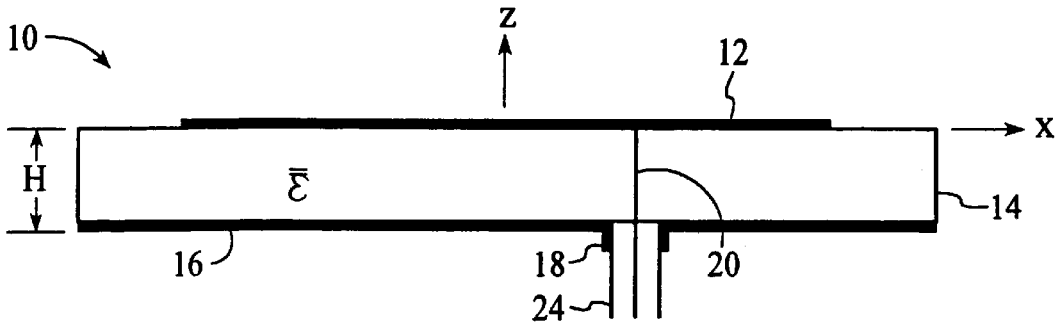
FIG. 2 (PRIOR ART)
FIG. 2 is a side view of the conventional antenna taken along cross-sectional line 2—2 in FIG. 1.

FIG. 17A-1 illustrates notched high permittivity isotropic slabs 204*a* and 204*b* in more detail. As shown in FIG. 17A-1, high permittivity slabs 204*a* and 204*b* have notches 212 along their length which allow the slabs to be interlocked together. In particular, slabs 204*a* have downwardly oriented notches 212*a* which define corresponding grooves, while slabs 204*b* have upwardly oriented notches 212*b* which define corresponding grooves. Accordingly, slabs 204*a* and 204*b* may be interlocked by orienting them perpendicular to one another and by pressing them together at a respective groove from each slab. The high permittivity slabs 204*a* and 204*b* are shown to be orthogonal to each other in FIG. 17A. However, in general, the slabs may be skewed so that the dihedral angles between slabs are not right angles. One example is shown in FIG. 17A-2 and FIG. 17A-2' which illustrates a cross-sectional view taken along sectional line 17A-2' of FIG. 17A-2. The high permittivity slabs 234*a* and 234*b* of FIG. 17A-2 are skewed so that the dihedral angles between the slabs are not right angles. Another example is shown in FIG. 17A-3 and FIG. 17A-3' which illustrates a cross-sectional view taken along sectional line 17A-3' of FIG. 17A-3, where the first set of slabs 274*a* are parallel to each other, and the second set of slabs, 274*b*, are arranged in a radial pattern below microstrip antenna 276 of a trapezoid shape. According to one embodiment, the high permittivity slabs are identical. For example, they may all have the same permittivity and thickness. In an alternative embodiment, the permittivity, or the thickness, or both may vary. According to one embodiment, the notches are equally spaced apart. However, in alternative embodiments the spacing can be variable, as illustrated in FIG. 17A-4.

It should be noted that an artificial dielectric based on interlocking approaches described above offer several advantages, without requiring substantially more material than that illustrated in the structure of FIG. 17. For example, construction is relatively easy and straightforward. Moreover, once all the slabs are interlocked the interlocked structure is self-supporting and can be used as a subassembly during the remainder of the manufacturing process.

The interstices 207 between, and defined by, the interlocking high permittivity slabs can be occupied by air, foam, or some other relatively low permittivity material. The mechanism for coupling RF energy to feeds 206-1 and 206-2 of microstrip patch 206 can be the same as that of the embodiment described in connection with FIG. 15 and so a description thereof need not be repeated here. As shown in FIG. 17B, feed probe 208 (or center conductor) of coaxial cable 210 connects to microstrip patch 206 at feed point 206-2 so as to couple. RF energy into the cavity formed under the patch 206 (another feed probe, not shown, would thus couple RF energy into the cavity at feed point 206-1). FIG. 17B also shows that the high permittivity slabs are spaced apart and define therebetween a volume 207 which can be occupied by air, foam, or some other low permittivity material.

It should be noted that the set of slabs 204*a*, 204*b*, and interstices 207 can be seen as forming a two dimensional periodic structure having an anisotropic permittivity tensor. The primary purpose of this artificial dielectric periodic structure is to enhance the effective permittivity in the z direction, while maintaining a relatively low mass for the substrate since a large fraction of the volume occupied is air, foam, or some other lightweight dielectric filler material. The tensor components of permittivity in the x and y directions (transverse directions under the patch) are not important, and can be minimized with this construction technique.

Figure 17C:
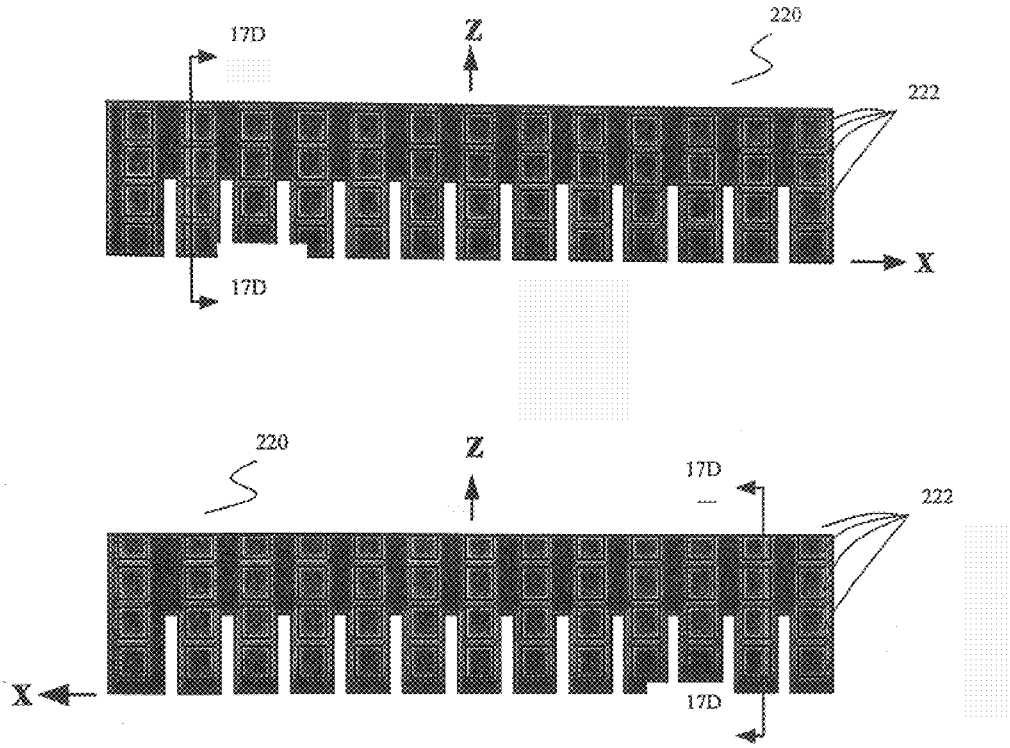
FIGS. 17C and 17D illustrates an anisotropic capacitive FSS card that can be used to implement the high permittivity interlocking slabs illustrated in FIG. 17A.
Figure 17D:
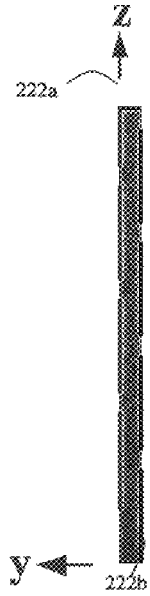

FIG. 17C and FIG. 17D illustrate an example of the invention where the interlocking slabs are comprised of anisotropic capacitive FSS cards 220. In particular, FIG. 17C shows a front and rear view of FSS card 220, and FIG. 17 is a cross-sectional view of card 220 taken along sectional line 17D—17D in FIG. 17C. FSS card 220 can be designed to offer a relatively high capacitance per unit area in the z direction, over the entire surface of the card. This is achieved using overlapping metal patches 222 which have significant parallel plate capacitance. As can be seen in FIG. 17D, by "overlapping" it is meant that a patch 222 printed on one side of card 220 overlaps at least two patches 222 printed on the opposite side of card 220. However, the effective capacitance in the x direction (or y direction for slabs oriented perpendicular to card 220) is relatively small. Underneath the microstrip patch, only the z component of the electric field is significant, so only the z component of effective capacitance is needed.

As further shown in FIG. 17D, FSS patches 222*a* and 222*b* which meet at the top and bottom edges, respectively, of the card 220, wrap around the corner to form a continuous conductive trace on the top and bottom card edges, respectively. This allows an ohmic contact to be established between the edges of card 220 and microstrip patch antenna 206 and ground plane 211, respectively. The dielectric material upon which the metal patches of the FSS card are printed may be any one of many conventional rigid substrate materials such as fiberglass (FR4), ceramic loaded plastic (Rogers R03000 or 404000 series), or even solid ceramic (alumina). According to alternative embodiments encompassed by the present invention, the capacitive FSS may be fabricated with three or four layers of overlapping patches if additional capacitance is needed. In a further alternative, although FIG. 17C shows the patches uniformly distributed along the entire length of card 220, this is not necessary and other distributions are possible. For instance, one may wish to taper the profile for the z component of effective permittivity as function of transverse coordinate (x or y coordinate) to obtain a specific input impedance level (other than 50 ohms), or to enhance the impedance bandwidth. This is simply done by controlling the amount of overlap among FSS patches.

FIG. 17E1 illustrates the paths of electric flux in an FSS card 220 as it may be used with a microstrip patch antenna. As illustrated in FIG. 17E1, the FSS cards support the dominant resonant mode of a microstrip patch antenna, by creating a path for electric flux which is in the z direction below the patch, and which also supports the z component of the fringing electric flux at the radiating edges of the patch. FIG. 17E2 illustrates an electric circuit representation of an FSS card 220. As shown in FIG. 17E2, the electric circuit representation is a parallel bank of strings 228 of series capacitors that are arranged in the z direction to support the flow of electric flux.

Figure 17G:
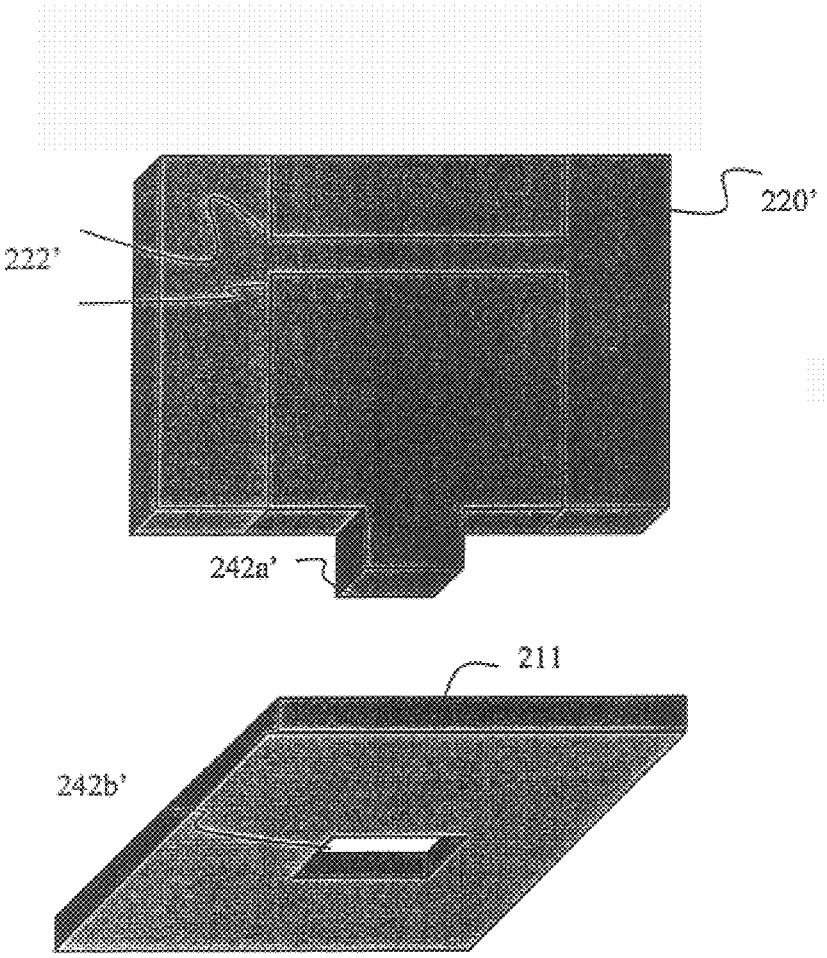
FIG. 17G illustrates a partial view of an alternative FSS card to that illustrated in FIG. 17F in accordance with an aspect of the invention.

FIG. 17F illustrates a partial FSS card with a tab that facilitates assembly in accordance with yet another aspect of the present invention. As shown in FIG. 17F, FSS card 220' includes a metalized tab 242*a* that fits into plated through slot 242*b* in a corresponding portion 244 of a patch antenna. While FIG. 17F for ease of presentation illustrates a single tab and a single slot it should be appreciated that in practice an FSS card can have many tabs which will be accepted by multiple corresponding slots on a patch antenna. Furthermore, while FIG. 17F shows a tab and a slot in a patch antenna, it should be appreciated that in an alternative embodiment an FSS card, as shown in FIG. 17G, has at the bottom a tab that fits into a corresponding slot in a ground plane. While FIG. 17G for ease of presentation illustrates a single tab and a single slot it should be appreciated that in practice an FSS card can have many tabs which will be accepted by multiple corresponding slots on a ground plane. In yet an alternative embodiment, an FSS card has tabs at both the bottom and top that fit into slots in a patch antenna and a ground plane. Once assembled, all the tab connections can be soldered to make the mechanical and electrical connections.

While this description of this artificial dielectric substrate employed the example of a microstrip patch antenna, many other types of resonators may benefit from the integration of this artificial dielectric structure. For instance, if a block of the artificial dielectric material is enclosed in metal walls, the interior will form a resonant cavity, which can be used in RF and microwave filter applications. Interlocking FSS cards can reduce the mass of a dielectric filler which is typically used for size reduction. This results in a dramatic weight reduction, especially when the conventional approach is to load the cavity with solid ceramics. This entire cavity including walls can be built from printed circuit cards, which use tabs and slots for assembly.

Figure 20:
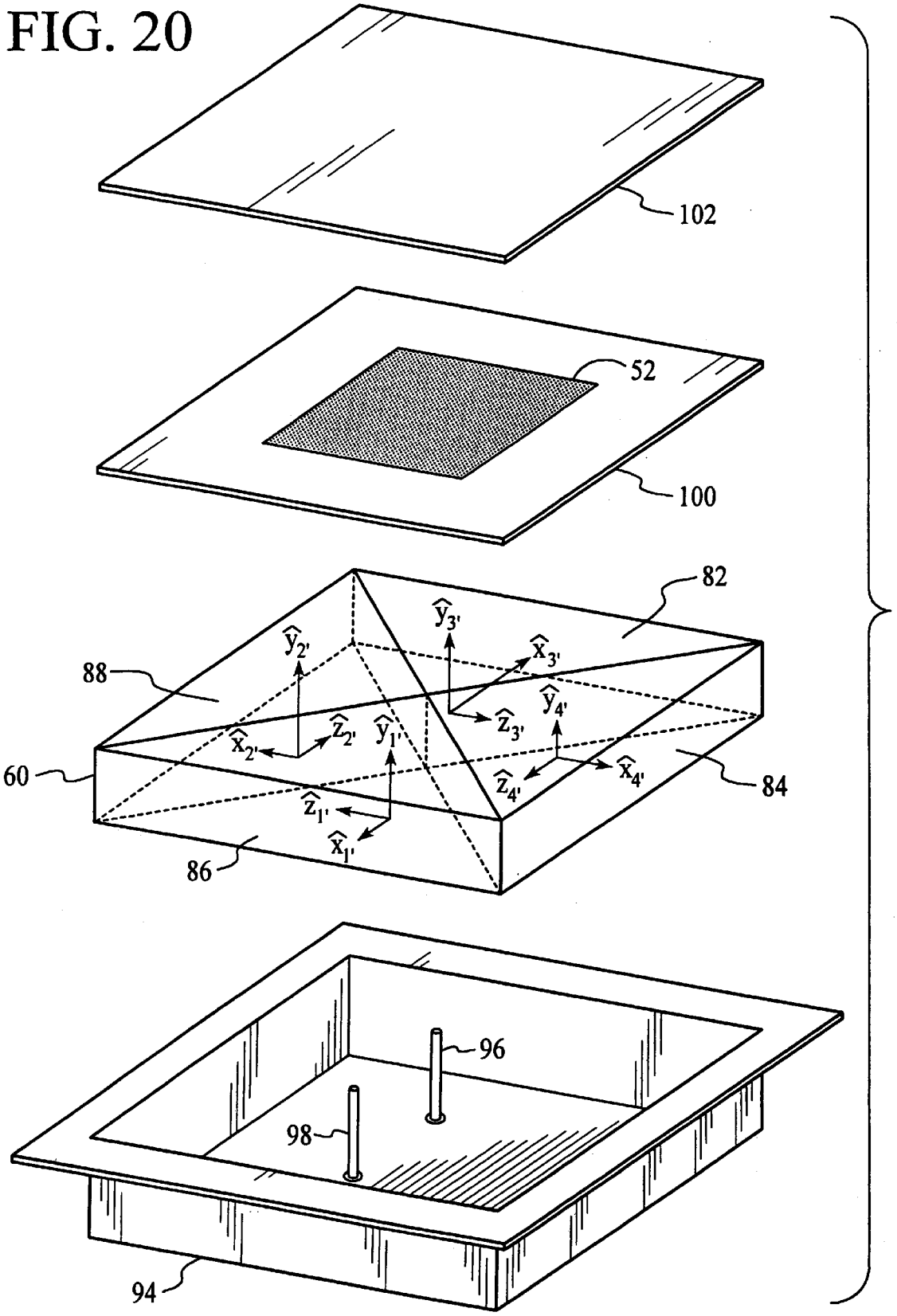
FIG. 20 is an assembly drawing illustrating the configuration of a patch antenna such as that illustrated in FIGS. 17 to 19.

FIG. 20 shows a perspective assembly drawing of a dual linearly-polarized patch antenna 50 constructed with an artificial dielectric substrate such as that illustrated in FIGS. 17 through 19. As can be seen, it includes a 8"×8"×2" aluminum cavity (a conformal housing) 94 in which are provided two feed probes 96 and 98 for connecting RF energy to the respective feeds 54 and 56 on patch 52. Patch 52 is provided on a superstrate 100, which can be, for example, a 8"×8"×0.060" thick Rogers R04003 printed circuit board. Although shown facing away from substrate 60 for illustrative purposes, patch 52 is preferably oriented on the side of superstrate 100 facing substrate 60 so that, when assembled together, patch 52 is in contact with substrate 60. Radome 102 is provided atop the cavity 94 to provide environmental protection for the antenna. This radome may be a simple planar dielectric sheet, such as a 0.060" thick layer of FR4 fiberglass.

In the artificial dielectric substrates illustrated above, a uniform layer thickness has been used throughout the substrate (i.e., uniform period). However, the layer thicknesses need not be uniform, and substrates having uniform layer thicknesses may not be desirable in, for example, microstrip patch antennas designed to resonate with higher order modes.

Figure 22:
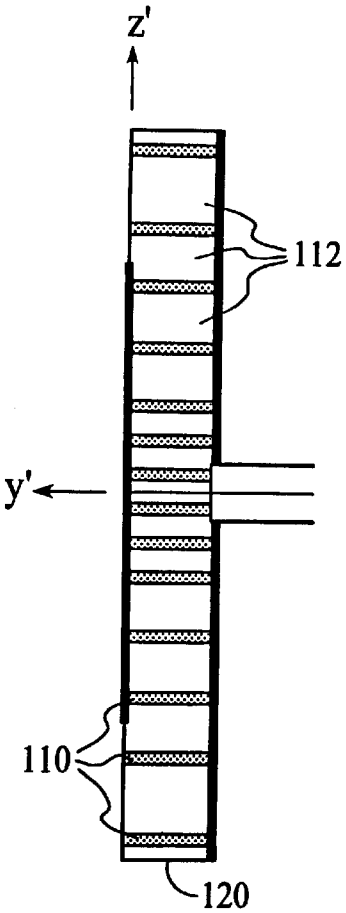
FIG. 22 is a side view of the antenna illustrated in FIG. 21 taken along sectional line 22—22.
Figure 21:
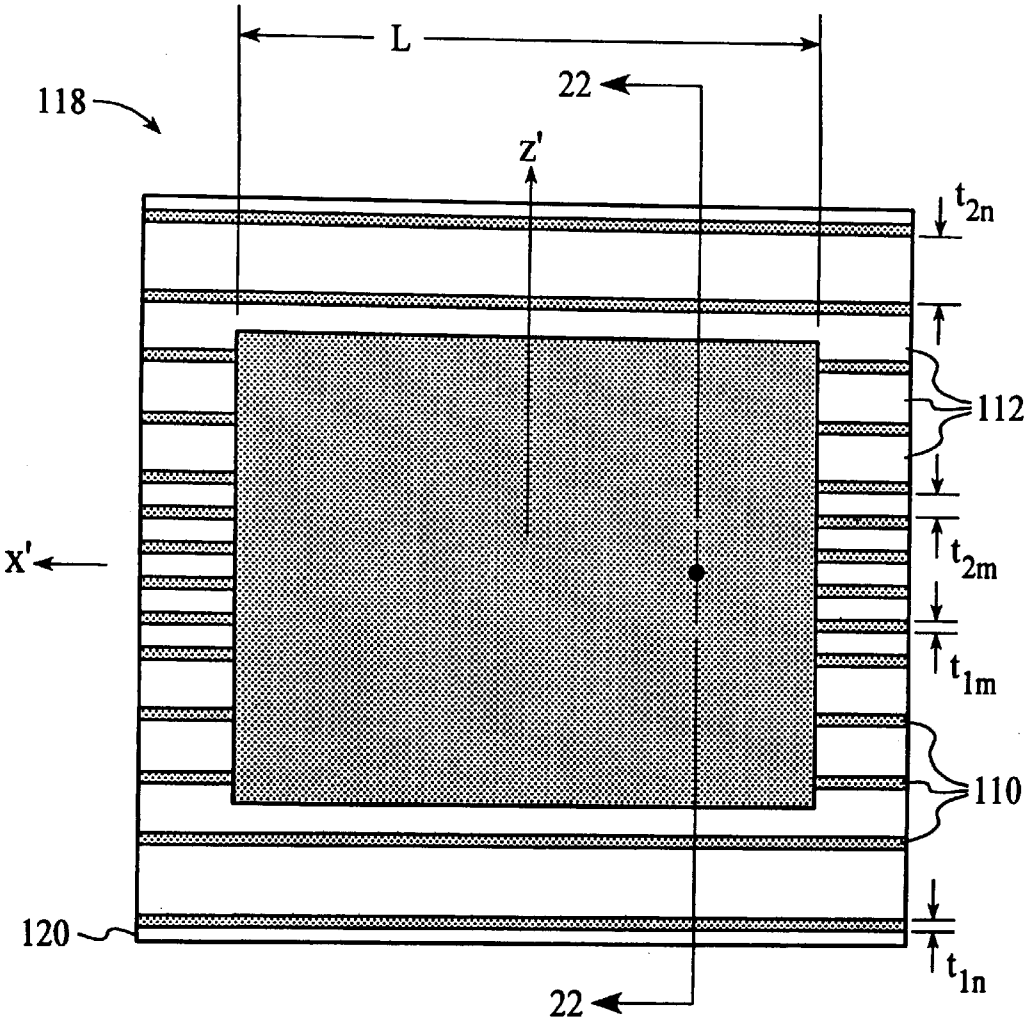
FIG. 21 is a top view of a patch antenna having a non-uniform artificial dielectric substrate in accordance with an aspect of the invention.

FIG. 21 illustrates a linearly-polarized patch antenna 118 having a nonuniform artificial dielectric substrate 120. FIG. 22 is a cross-sectional view of antenna 118 taken along sectional line 22—22 in FIG. 21. Both the high and low permittivity dielectric layers, 110 and 112, respectively, may have a variable thickness in the z' direction. That is, as illustrated, layers 110 may have thickness $t_{1m}$ near the center of the substrate, and thickness $t_{1n}$ near the periphery of the substrate in the z' direction, where $t_{1m} \neq t_{1n}$. Likewise, layers 112 may have thickness $t_{2m}$ near the center of the substrate, and thickness $t_{2n}$ near the periphery of the substrate in the z'-direction, where $t_{2m} \neq t_{2n}$.

Figure 24:
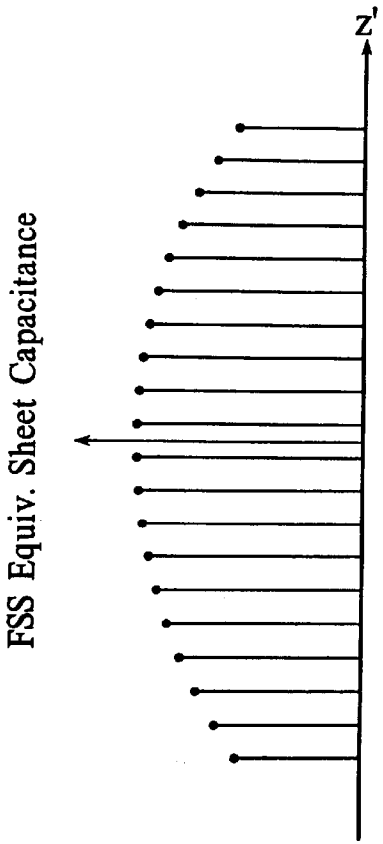
FIG. 24 is a graph illustrating the non-uniform equivalent sheet capacitance of FSS layers in the artificial dielectric substrate illustrated in FIG. 23.
Figure 23:
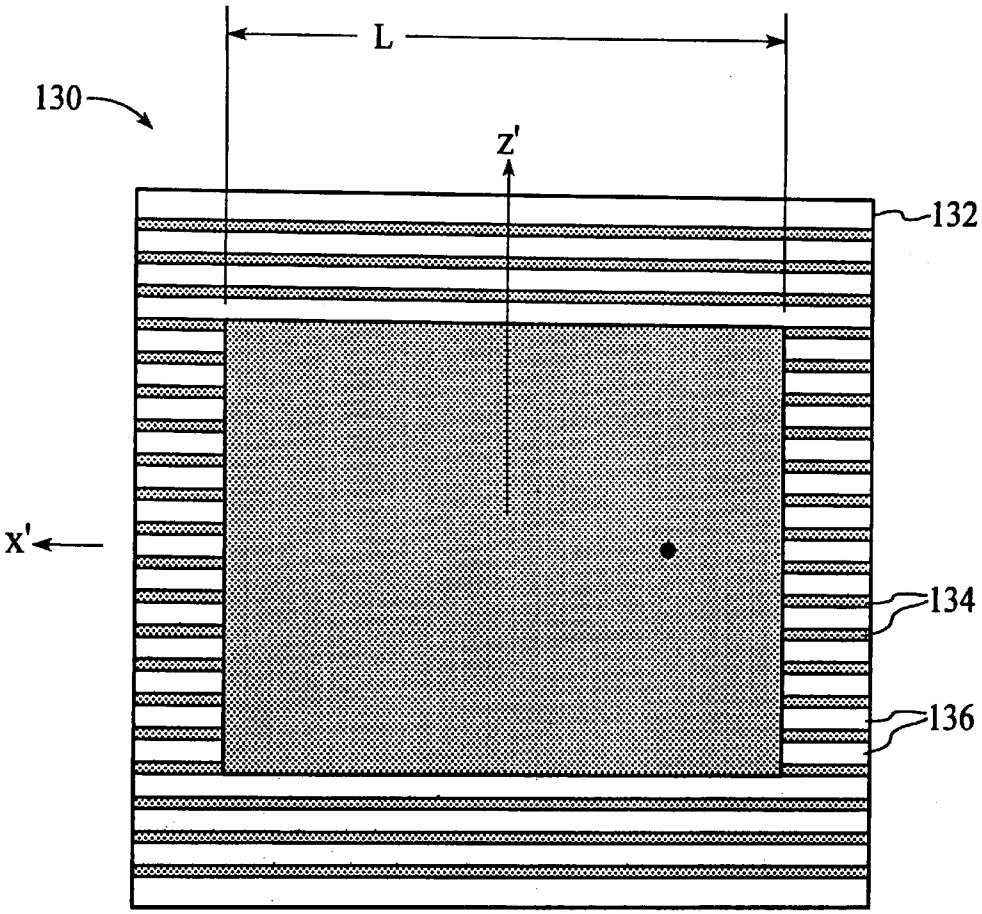
FIG. 23 is a top view of a patch antenna having a non-uniform artificial dielectric substrate in accordance with another aspect of the invention.

Another degree of freedom, by virtue of the FSS dielectric layer concept according to the invention, is to employ capacitive FSS layers of non-uniform equivalent sheet capacitance in a regular period to achieve a non-uniform distribution of effective dielectric constant. FIG. 23 illustrates a linearly-polarized patch antenna 130 having a non-uniform artificial dielectric substrate 132. The layers in substrate 132 are comprised of alternating high permittivity FSS materials 134 and low permittivity dielectric materials 136. FIG. 24 is a histogram that further illustrates the non-uniform equivalent sheet capacitance of corresponding layers 134 in substrate 132. As can be seen, layers 134 near the center of the substrate in the z' direction have a higher equivalent sheet capacitance than layers 134 near the periphery of the substrate. Depending on the electric field distribution of the desired patch antenna resonant mode, it may be preferred to vary the non-uniform equivalent sheet capacitance such that it is higher near the perimeter of the patch or periphery of the substrate, and lower near the center.

Figure 25:
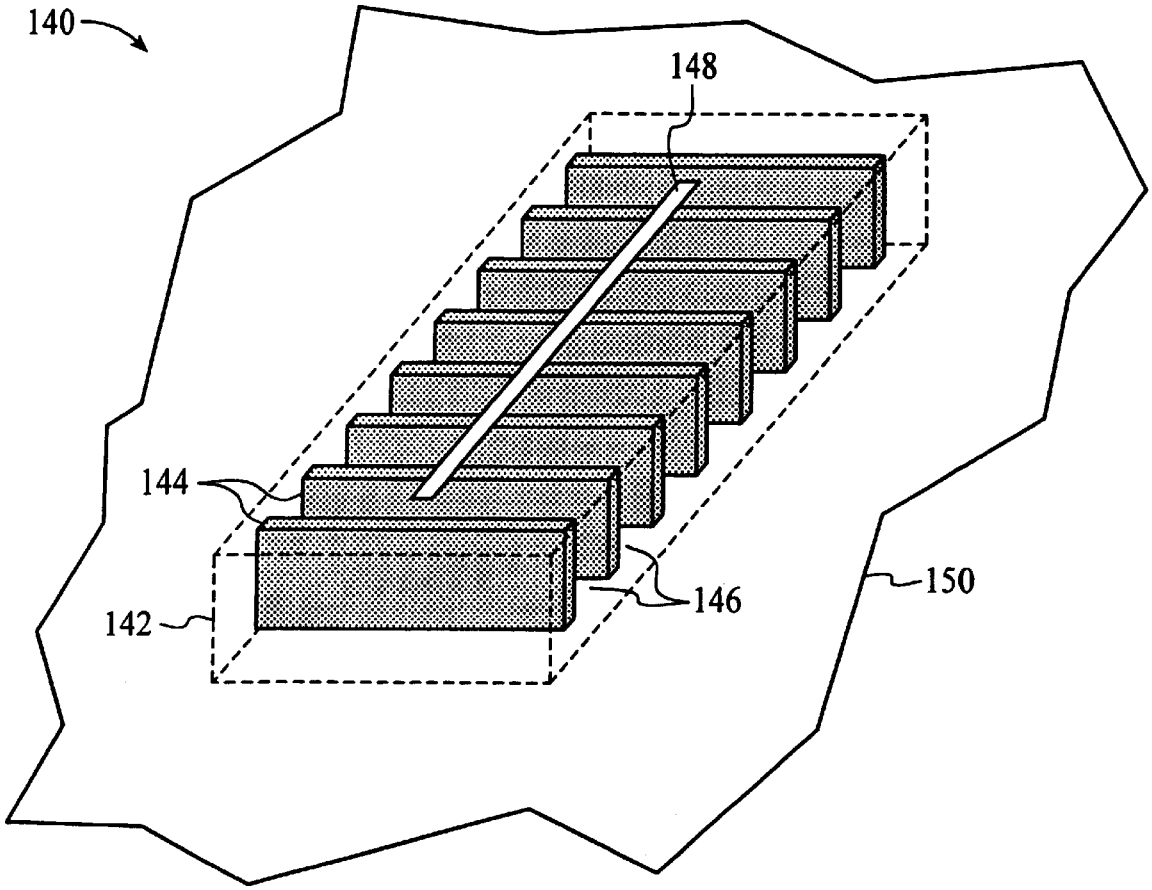
FIG. 25 is a perspective view of a radiating slot antenna having an artificial dielectric substrate in accordance with the principles of the invention.

The principles of the invention can be applied to other cavity-backed antennas in addition to the microstrip patch antennas described hereinabove. For example, FIG. 25 illustrates a slot antenna 140 in which cavity 142 houses an artificial dielectric substrate comprised of alternating high permittivity layers 144 and low permittivity layers 146. Disposed between the substrate and ground plane 150 is a rectangular radiating slot 148. The high permittivity layers 144 can be, for example, FSS layers, and the high permittivity layers 146 can be, for example, foam spacers.

Figure 26:
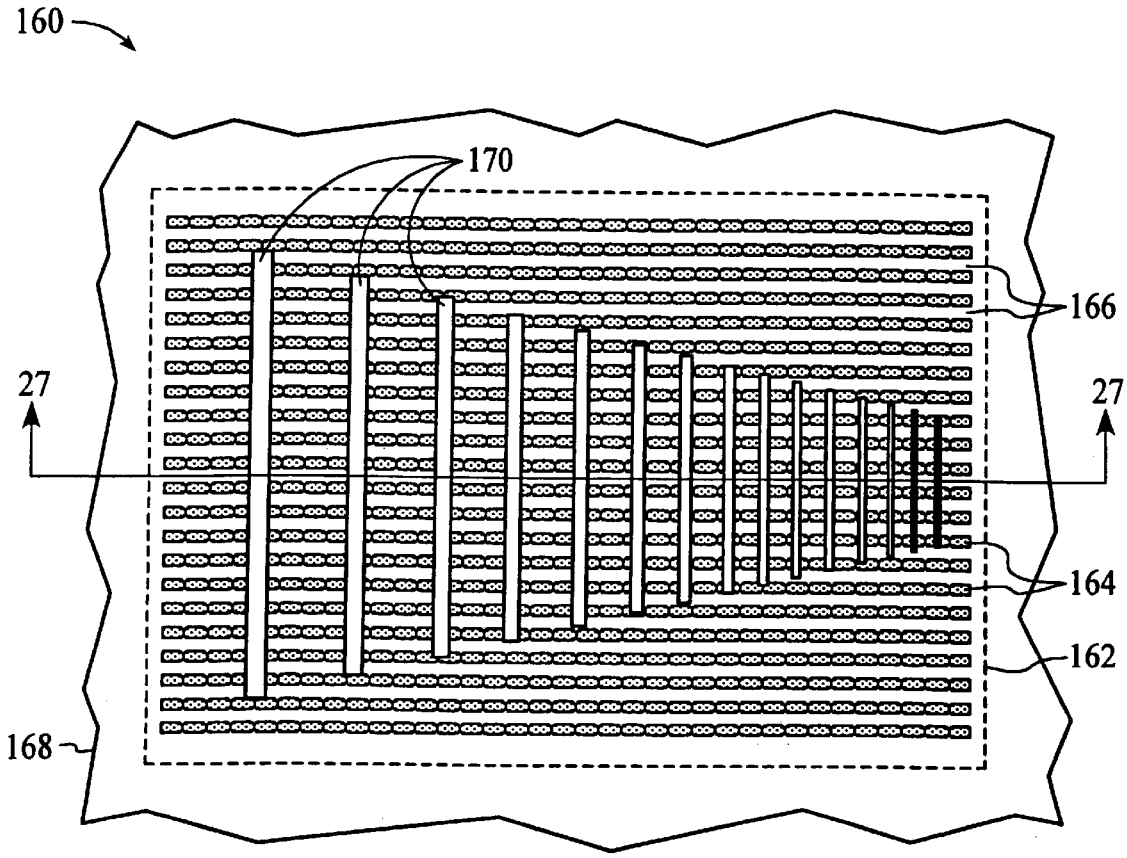
FIG. 26 is a top view of a log-periodic slot array having an artificial dielectric substrate in accordance with the principles of the invention.
Figure 27:
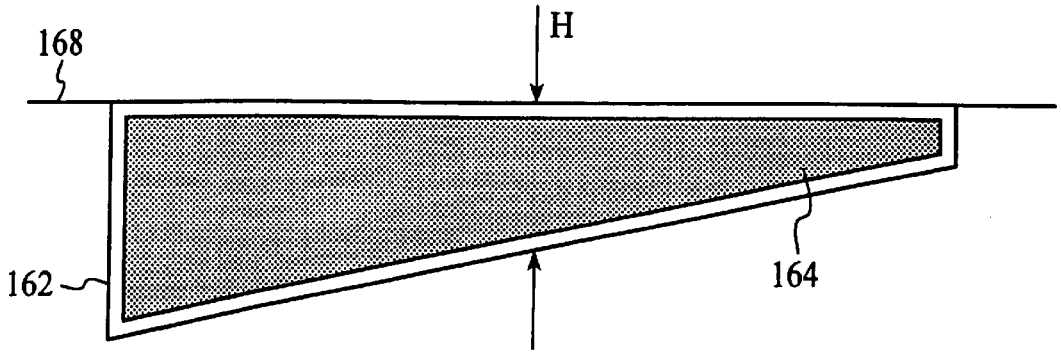
FIG. 27 is a side view of the antenna illustrated in FIG. 26 taken along sectional line 27—27.

FIG. 26 illustrates another example of the invention applied to a log-periodic slot array antenna 160 in which cavity 162 houses an artificial dielectric substrate comprised of alternating high permittivity layers 164 and low permittivity layers 166. Disposed between the substrate and ground plane 168 is a log periodic array of rectangular radiating slots 170. The high permittivity layers 164 can be, for example, FSS layers, and the high permittivity layers 166 can be, for example, foam spacers. FIG. 27 is a cross-sectional view of FIG. 26 taken along line 27—27 in FIG. 26, and it shows how the height H of the artificial dielectric substrate having high permittivity layer 164 decreases in relation to the decreasing length, width and spacing of rectangular radiating slots 170.

Figure 28:
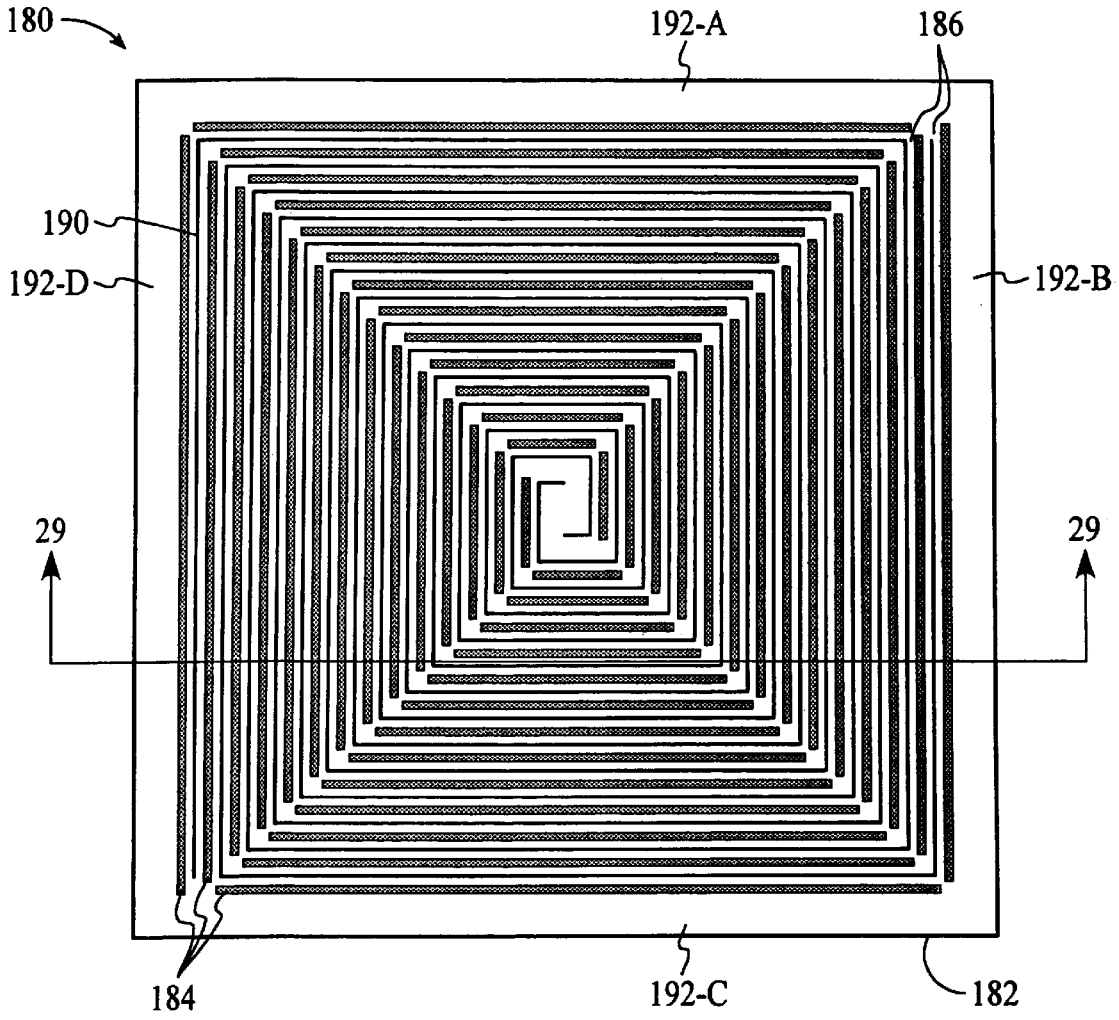
FIG. 28 is a top view of a cavity-backed Archimedian spiral antenna having an artificial dielectric substrate in accordance with the principles of the invention.
Figure 29:
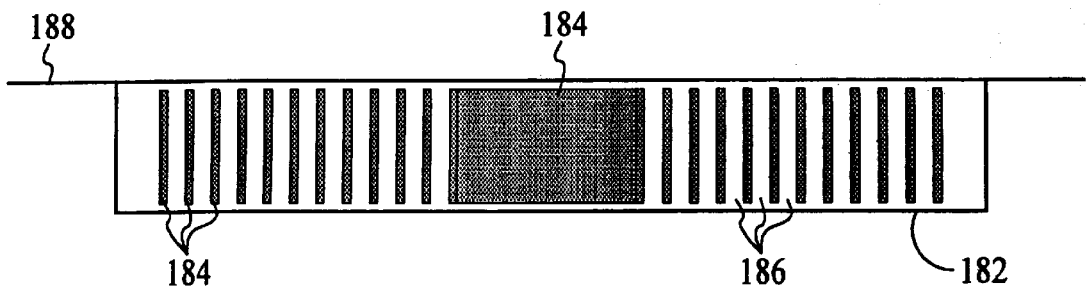
FIG. 29 is a side view of the antenna illustrated in FIG. 28 taken along sectional line 29—29.

FIG. 28 illustrates yet another example of the invention applied to a cavity-backed Archimedian spiral antenna 180 in which cavity 182 houses an artificial dielectric substrate comprised of four regions 192-A, 192-B, 192-C and 192-D of alternating high permittivity layers 184 and low permittivity layers 186, similar to the artificial dielectric substrate described with relation to FIG. 17. Disposed between the substrate and ground plane 188 is a radiating Archimedian spiral element 190. The high permittivity layers 184 can be, for example, FSS layers, and the high permittivity layers 186 can be, for example, foam spacers. FIG. 29 is a cross-sectional view of FIG. 28 taken along line 29—29 in FIG. 28.

Figure 30:
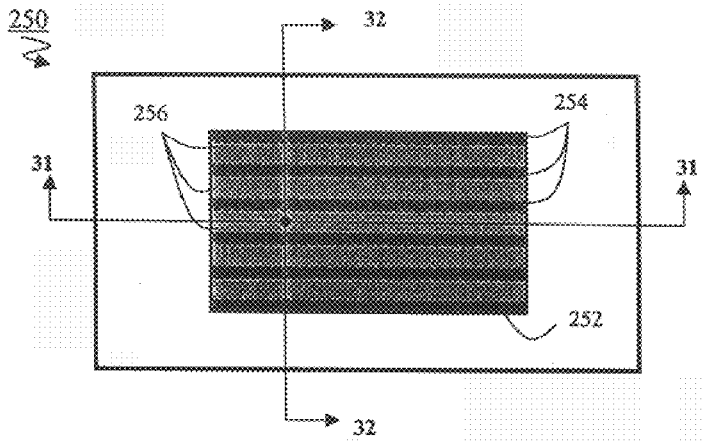
FIG. 30 is a top view illustrating a planar inverted F antenna (PIFA) containing an anisotropic artificial dielectric substrate in accordance with an aspect of the invention.
Figure 32:
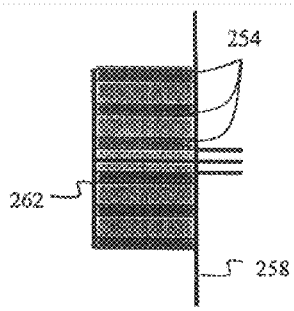
FIG. 32 is a cross-sectional view of the PIFA of FIG. 30 taken along lines 32—32.
Figure 31:
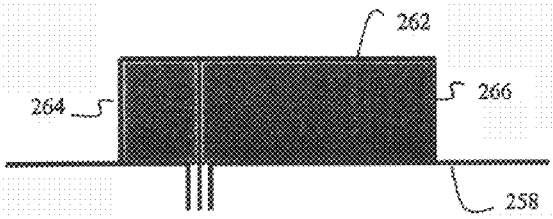
FIG. 31 is a cross-sectional view of the PIFA of FIG. 30 taken along lines 31—31.

FIG. 30 illustrates a planar inverted F antenna (PIFA) containing an anisotropic artificial dielectric substrate in accordance with another embodiment of the invention. In particular, PIFA 250 includes a substrate 252 which comprises spaced apart layers of high permittivity slabs 254. Spaces between the slabs (or cards) can be air, foam, or any relatively low $\in_r$ material 256. The slabs can be comprised of FSS cards or any of the high permittivity slabs described herein. By loading the PIFA cavity with an isotropic artificial dielectric material or FSS cards the size and weight of the antenna can be reduced relative to a PIFA antenna with a solid dielectric substrate. FIG. 31 is a cross-sectional view of antenna 250 taken along line 31—31 and FIG. 32 is a cross-sectional view taken along line 32—32. The direction of the dominant mode electric field is from ground plane 258 up to PIFA lid 262, and standing waves run the length of the lid 262, between shorting wall 264 and the radiating aperture 266.

Another embodiment of a PIFA antenna containing an anisotropic artificial dielectric substrate is shown in FIG. 33 where the shorting wall has been replaced with a more economical shorting pin. Although the pin has a larger inductance than the shorting wall, the pin may help to improve the impedance match in some designs. Furthermore, multiple shorting pins may be used such as shown in FIG. 34. There are various combinations of locations for feed probes and shorting pins, which are known to those skilled in the art of PIFA design. The point we are teaching here is that the high permittivity slabs are oriented so as to increase the z component of effective permittivity under the PIFA lid. The benefit of this approach is to reduce the volume occupied by the PIFA by slowing down the phase velocity for waves traveling through the PIFA's substrate.

FIGS. 30, 33, and 34 show uniformly spaced high permittivity slabs 254. If such slabs are uniform, they do not necessarily need to be uniformly spaced as a periodic structure. Non-uniform spacing will also realize the benefits of reduced antenna size with a low mass substrate. Also, if the high permittivity slabs 254 are printed FSS cards, then a non-uniform capacitance per unit square, tapered in the x longitudinal direction for standing waves, can be used as another engineering degree of freedom to adjust the input impedance and bandwidth.

Although the present invention has been described in detail with reference to the preferred embodiments thereof, those skilled in the art will appreciate that various substitutions and modifications can be made thereto without departing from the inventive concepts set forth herein. Accordingly, the present invention is not limited to the specific examples described; rather, these and other variations can be made while remaining within the spirit and scope of the invention as defined in the appended claims.

We claim:

1. An artificial dielectric structure comprising:

a first set of dielectric slabs having a first relative permittivity;

a second set of dielectric slabs having a second relative permittivity;

wherein the first set of slabs is interlocked with the second set of slabs to define interstices occupied by material having a third relative permittivity different from the first relative permittivity and the second relative permittivity of the slabs; and wherein the interlocked sets of slabs have an overall permittivity tensor that includes a permittivity tensor component along a certain axis that is substantially different than other permittivity tensor components in other directions.

2. The artificial dielectric structure of claim 1, wherein the first set of dielectric slabs and the second set of dielectric slabs are interlocked such that they form non-right angle dihedral angles.

3. The artificial dielectric structure of claim 1, wherein the first set of dielectric slabs is substantially parallel and the second set is in a radial pattern.

4. The artificial dielectric structure of claim 1, wherein the spacing among the slabs in the first set is non-uniform.

5. The artificial dielectric structure of claim 4, wherein the spacing among the slabs in the second set is non-uniform.

6. The artificial dielectric structure of claim 1, wherein the first set of dielectric slabs is substantially parallel and the second set of dielectric slabs is substantially parallel.

7. The artificial dielectric structure of claim 1, wherein said other permittivity tensor components are lower than said permittivity tensor component along said certain axis.

8. The artificial dielectric structure of claim 1, wherein the first set of slabs includes a first slab having a first thickness $t_1$ and a second slab, said first slab and second slab spaced apart and defining in between them a second region having a second thickness $t_2$, and said first slab and said second region have first slab permittivity and second region permittivity $\in_{r1}$ and $\in_{r2}$ respectively, said first and second thicknesses satisfying the condition that $t_n << 1/\beta_n$, where $\beta_n = \omega \times \mathrm{sqrt}(\mu_0 \in_0 \in_{rn})$ for n=1,2, and $\omega = 2\pi f$ where f is the maximum operating frequency of said artificial dielectric structure.

9. The artificial dielectric structure of claim 8, wherein the second set of slabs includes a third slab having a third thickness $t_3$ and a fourth slab, said third slab and fourth slab spaced apart and defining in between them a third region having a fourth thickness $t_4$, and the third slab and the fourth region have third slab permittivity and fourth region permittivity $\in_{r3}$ and $\in_{r4}$ respectively, said third and fourth thicknesses satisfying the condition that $t_n<<1/\beta_n$, where $\beta_n=\omega\times\text{sqrt}(\mu_0\in_0\in_{rn})$ for n=3,4, and $\omega=2\pi f$ where f is the maximum operating frequency of said artificial dielectric structure.

10. The artificial dielectric structure as defined in claim 1, wherein said other two of said first permittivity tensor components are substantially equal.

11. The artificial dielectric structure as defined in claim 1, wherein said other permittivity tensor components are substantially equal.

12. The artificial dielectric structure as defined in claim 1, wherein certain of the first set of dielectric slabs are comprised of an artificial dielectric material.

13. The artificial dielectric structure as defined in claim 1, wherein certain of said first set of dielectric slabs are comprised of a capacitive frequency selective surface card.

14. The artificial dielectric structure as defined in claim 13, wherein the capacitive frequency selective surface card includes at least one tab that is adapted to be inserted into at least one slot of at least one of a microstrip patch and a ground plane.

15. The artificial dielectric structure as defined in claim 13, wherein the frequency selective surface card includes at least one patch which forms a continuous electrical trace over the top edge of the frequency selective surface card.

16. The artificial dielectric structure as defined in claim 13, wherein the frequency selective surface card includes at least one patch which forms a continuous electrical trace over the bottom edge of the frequency selective surface card.

17. An antenna comprising:

a radiating element that is adapted to receive RF energy;

a metalized ground plane; and a substrate disposed between said radiating element and said metalized ground plane, said substrate comprising a first set of dielectric slabs having a first relative permittivity and a second set of dielectric slabs having a second relative permittivity;

wherein the first set of slabs is interlocked with the second set of slabs; and wherein the interlocked sets of slabs have an overall permittivity tensor that includes a permittivity tensor component along a certain axis that is substantially different than other permittivity tensor components in other directions.

18. The artificial dielectric structure of claim 17, wherein said other permittivity tensor components are lower than said permittivity tensor component along said certain axis.

19. The artificial dielectric structure of claim 17, wherein the first set of slabs includes a first slab having a first thickness $t_1$ and a second slab, the first slab and second slab spaced apart and defining between them a second region having, a second thickness $t_2$, the first slab and the second region have a first slab permittivity and second region permittivity $\in_{r1}$ and $\in_{r2}$ respectively, and said first and second thicknesses satisfying the condition that $t_n<<1/\beta_n$, where $\beta_n\omega\times\text{sqrt}(\mu_0\in_0\in_{rn})$ for n=1,2, and $\omega=2\pi f$ where f is the maximum operating frequency of said artificial dielectric structure.

20. The artificial dielectric structure of claim 19, wherein the second set of slabs includes a third slab having a third thickness $t_3$ and a fourth slab, the third slab and the fourth slab spaced apart and defining between them a fourth region having a fourth thickness $t_4$, the third slab and the fourth region have third slab permittivity and fourth region permittivity $\in_{r3}$ and $\in_{r4}$ respectively, and said third and fourth thicknesses satisfying the condition that $t_n<<1/\beta_n$, where $\beta_n\omega\times\text{sqrt}(\mu_0\in_0\in_{rn})$ for n=3,4, and $\omega=2\pi f$ where f is the maximum operating frequency of said artificial dielectric structure.

21. An antenna as defined in claim 17, further comprising:

a first feed probe that is adapted to couple RF energy to said radiating element.

22. An antenna as defined in claim 21, further comprising:

a second feed probe that is adapted to couple RF energy to said radiating element, said first and second feed probes being adapted to couple to independent principal modes of surface currents in said radiating element.

23. An antenna as defined in claim 21, wherein said other two of said permittivity components are substantially equal.

24. An antenna as defined in claim 17, wherein the first set of slabs includes a first slab comprised of an artificial dielectric material.

25. An antenna as defined in claim 17, wherein said radiating element is comprised of a microstrip patch.

26. An antenna as defined in claim 17, wherein said radiating element is comprised of a radiating slot.

27. An antenna as defined in claim 17, wherein the overall permittivity tensor is substantially normal to the radiating element.

28. An antenna as defined in claim 17, further comprising a cavity that houses said substrate.

29. An antenna as defined in claim 28, wherein said radiating element is comprised of a microstrip patch.

30. An antenna as defined in claim 28, wherein said radiating element is comprised of a radiating slot.

31. An antenna as defined in claim 24, wherein said first slab is comprised of a capacitive frequency selective surface card.

32. The artificial dielectric structure as defined in claim 31, wherein the capacitive frequency selective surface card includes at least one tab that is adapted to be inserted into at least one slot of at least one of a microstrip patch and a ground plane.

33. The artificial dielectric structure as defined in claim 31, wherein the frequency selective surface card includes at least one, patch which forms a continuous electrical trace over the top edge of the frequency selective surface card.

34. The artificial dielectric structure as defined in claim 31, wherein the frequency selective surface card includes at least one patch which forms a continuous electrical trace over the bottom edge of the frequency selective surface card.

35. An antenna comprising:

a radiating element that is adapted to receive RF energy;

a metalized ground plane; and a substrate disposed between said radiating element and said metalized ground plane, said substrate comprising a first set of dielectric slabs spaced apart and having a first relative permittivity and a second set of dielectric slabs spaced apart and having a second relative permittivity;

wherein the first set of slabs is interlocked with the second set of slabs to define interstices occupied by material having a third relative permittivity different from the first relative permittivity and the second relative permittivity of the slabs; and wherein the interlocked sets of slabs have an overall permittivity tensor that includes a permittivity tensor component along a certain axis that is substantially different than other permittivity tensor components in other directions; and wherein said radiating element has a surface and the first set of slabs are spaced apart in a first direction, said surface being parallel to said first direction.

36. A method of providing an antenna substrate with a desired permittivity $\in_d$, wherein said antenna substrate is adapted for use in a microstrip patch antenna having a patch with a patch surface, said method comprising:

identifying a first dielectric material having a first permittivity $\in_{r1}$;

identifying a second dielectric material having a second permittivity $\in_{r2}$, said first and second dielectric materials each having substantially parallel top and bottom surfaces;

adjusting respective first and second thicknesses $t_1$ and $t_2$ between said top and bottom surfaces of said first and second dielectric materials in accordance with said desired permittivity;

interlocking notched slabs of the first dielectric material thereby defining a first set of the slabs that are spaced apart in a first direction perpendicular to said top and bottom surfaces of the first set of the slabs and a second set of the slabs that are spaced apart in a second direction perpendicular to the top and bottom surfaces of the second set of the slabs;

allowing the second dielectric material to occupy the unoccupied volume defined by the interlocked notched slabs of the first dielectric material;

orienting said interlocked notched slabs and second dielectric material so that said first direction is parallel to said patch surface.

37. A method as defined in claim 36, wherein said antenna substrate is adapted for use in an antenna having a maximum operating frequency f($\omega=2\pi f$), said method further comprising:

maintaining the condition that $t_n<<1/\beta_n$, where $\beta_n=\omega\times\text{sqrt}(\mu_0\in_0\in_{rn})$ for n=1,2.

38. A method as defined in claim 36, wherein said antenna substrate has a desired weight, said first and second dielectric materials having first and second specific gravities, respectively, said adjusting step being performed in further accordance with said desired weight.

39. An antenna comprising:

a radiating element that is adapted to receive RF energy;

at least one shorting element perpendicularly coupled at a first end to one end of the radiating element;

a metalized ground plane, perpendicularly coupled at one end of the ground plane to a second end of the at least one shorting element;

wherein the radiating element, the at least one shorting element and the metalized grounds plane define a resonator having a radiating aperture opposite the at least one shorting element; and a substrate disposed between said element and said metalized ground plane, said substrate comprising first and second stacked dielectric layers having first and second permittivity, respectively, said first permittivity being different from said second permittivity, wherein said substrate has a permittivity tensor comprised of permittivity components respectively defined along three principal axes, one of said permittivity components along a certain axis of said principal axes, in a direction normal to the ground plane, being substantially different than both of the other two of said permittivity components, and wherein said dielectric layers each have substantially parallel top and bottom surfaces and are stacked in a first direction perpendicular to said top and bottom surfaces such that said top surface of said first dielectric layer is adjacent to said bottom surface of said second dielectric layer, said first direction being parallel to said radiating element and ground plane.

40. The antenna of claim 39, wherein said other two of said permittivity components are smaller than said one permittivity component along said certain axis by at least a factor of 5.

41. The antenna of claim 39, wherein said first and second dielectric layers have first and second thicknesses $t_1$ and $t_2$, and first and second permittivity $\in_{r1}$ and $\in_{r2}$ respectively, said first and second thicknesses satisfying the condition that $t_n<<1/\beta_n$, where $\beta_n\omega\times\text{sqrt}(\mu_0\in_0\in_m)$ for n=1,2, and $\omega=2\pi f$ where f is the maximum operating frequency of said artificial dielectric structure.

42. The antenna of claim 39, wherein the one of the first and second dielectric layers is comprised of a capacitive frequency selective surface card that includes at least one tab that is adapted to be inserted into at least one slot of at least one of a microstrip patch and a ground plane.

43. The antenna of claim 39, wherein the one of the first and second dielectric layers is comprised of a capacitive frequency selective surface card that includes at least one patch which forms a continuous electrical trace over the top edge of the frequency selective surface card.

44. The antenna of claim 39, wherein the one of the first and second dielectric layers is comprised of a capacitive frequency selective surface card that includes at least one patch which forms a continuous electrical trace over the bottom edge of the frequency selective surface card.

45. An antenna as defined in claim 39, wherein the at least one shorting element is a shorting wall.

46. An antenna as defined in claim 39, further comprising:

a first feed probe that is adapted to couple RF energy to said element.

47. A frequency selective surface card that is adapted to be disposed in between a microstrip patch and a ground plane, the frequency selective card comprising:

at least one tab that is adapted to be inserted into at least one slot of at least one of the microstrip patch and the ground plane.

48. A frequency selective surface card that is adapted to be disposed in between a microstrip patch and a ground plane, the frequency selective card comprising:

at least one patch which forms a continuous electrical trace over the top edge of the frequency selective surface card.

49. A frequency selective surface card that is adapted to be disposed in between a microstrip patch and a ground plane, the frequency selective card comprising:

at least one patch which forms a continuous electrical trace over the bottom edge of the frequency selective surface card.

* * * * *